US007972474B2

(12) United States Patent
Underhill et al.

(10) Patent No.: US 7,972,474 B2
(45) Date of Patent: Jul. 5, 2011

(54) TISSUE PRODUCTS HAVING ENHANCED CROSS-MACHINE DIRECTIONAL PROPERTIES

(75) Inventors: Richard Underhill, Neenah, WI (US); Jeff Sonnenberg, Sherwood, WI (US); Kevin Vogt, Neenah, WI (US); Jeff Mathews, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1370 days.

(21) Appl. No.: 11/301,632

(22) Filed: Dec. 13, 2005

(65) Prior Publication Data

US 2007/0131366 A1 Jun. 14, 2007

(51) Int. Cl.
*D21H 11/00* (2006.01)

(52) U.S. Cl. ..... 162/111; 162/109; 428/156

(58) Field of Classification Search ..... 162/109, 162/111; 428/156
See application file for complete search history.

(56) References Cited

U.S. PATENT DOCUMENTS

| | | | | |
|---|---|---|---|---|
| 3,585,104 | A | 6/1971 | Kleinert | |
| 4,594,130 | A | 6/1986 | Chang et al. | |
| 4,793,898 | A | 12/1988 | Laamanen et al. | |
| 5,595,628 | A | 1/1997 | Gordon et al. | |
| 5,607,551 | A | 3/1997 | Farrington, Jr. et al. | |
| 5,656,132 | A | 8/1997 | Farrington, Jr. et al. | |
| 5,772,845 | A * | 6/1998 | Farrington et al. | 162/109 |
| 5,932,068 | A | 8/1999 | Farrington, Jr. et al. | |
| 6,017,417 | A | 1/2000 | Wendt et al. | |
| 6,171,442 | B1 | 1/2001 | Farrington, Jr. et al. | |
| 6,673,202 | B2 * | 1/2004 | Burazin et al. | 162/109 |
| 6,808,599 | B2 | 10/2004 | Burazin et al. | |
| 6,846,383 | B2 | 1/2005 | Tirimacco | |
| 6,918,993 | B2 | 7/2005 | Tirimacco | |
| 6,994,770 | B2 | 2/2006 | Shannon et al. | |
| 2005/0133175 | A1 | 6/2005 | Hada et al. | |
| 2005/0136222 | A1 | 6/2005 | Hada et al. | |
| 2005/0252626 | A1 * | 11/2005 | Chen et al. | 162/125 |

OTHER PUBLICATIONS

TAPPI—T 411 om-89 entitled "Thickness (caliper) of paper, paperboard, and combined board", Jun. 15, 1989, 3 pages.

* cited by examiner

*Primary Examiner* — Matthew J Daniels
*Assistant Examiner* — Jacob Thomas Minskey
(74) *Attorney, Agent, or Firm* — Dority & Manning, P.A.

(57) ABSTRACT

Tissue products are disclosed having desirable strength, stretch and softness properties. In particular, the tissue products exhibit relatively high strength while still having a relatively low stiffness and a significant amount of stretch. The tissue webs generally comprise uncreped through-air dried webs. In accordance with the present disclosure, the webs are formed in a through-air drying process in which the transfer fabric and the through-air drying fabric are both textured fabrics having a substantially uniform high strain distribution in the cross-machine direction. Various improvements in properties in the cross-machine direction are exhibited by deforming or molding a tissue web against one or more of the fabrics during the tissue making process.

30 Claims, 2 Drawing Sheets

TISSUE PRODUCTS HAVING ENHANCED CROSS-MACHINE DIRECTIONAL PROPERTIES

BACKGROUND OF THE INVENTION

In the manufacture of tissue products such as bath tissue, a wide variety of product characteristics must be given attention in order to provide a final product with the appropriate blend of attributes suitable for the product's intended purposes. Improving the softness of tissues without compromising strength is a continuing objective in tissue manufacture, especially for premium products. Softness, however, is a perceived property of tissues comprising many factors including thickness, smoothness, and fuzziness.

In order to improve the softness of tissue products while retaining sufficient strength, various two-ply tissue products have been proposed. However, in terms of manufacturing economy, multiple-ply products are typically more expensive to produce than single-ply products. Thus, a need exists for a single-ply tissue product with high bulk and softness while retaining strength.

Traditionally, tissue products have been made using a wet-pressing process in which a significant amount of water is removed from a wet-laid web by pressing the web prior to final drying. In one embodiment, for instance, while supported by an absorbent papermaking felt, the web is squeezed between the felt and the surface of a rotating heated cylinder (Yankee dryer) using a pressure roll as the web is transferred to the surface of the Yankee dryer for final drying. The dried web is thereafter dislodged from the Yankee dryer with a doctor blade (creping), which serves to partially debond the dried web by breaking many of the bonds previously formed during the wet-pressing stages of the process. Creping generally improves the softness of the web, albeit at a loss in strength.

Recently, throughdrying has increased in popularity as a means of drying tissue webs. Throughdrying provides a relatively noncompressive method of removing water from the web by passing hot air through the web until it is dry. More specifically, a wet-laid web is transferred to a coarse, highly permeable throughdrying fabric and retained on the throughdrying fabric until it is at least almost completely dry. The resulting dried web can be softer and bulkier than a wet-pressed sheet because fewer papermaking bonds are formed and because the web is less dense. Squeezing water from the wet web is eliminated, although subsequent transfer of the web to a Yankee dryer for creping is still often used to final dry and/or soften the resulting tissue.

Even more recently, significant advances have been made in high bulk sheets as disclosed in U.S. Pat. Nos. 5,607,551; 5,772,845; 5,656,132; 5,932,068; and 6,171,442, which are all incorporated herein by reference. These patents disclose soft throughdried tissues made without the use of a Yankee dryer.

Even in view of the advances disclosed in the above patents, further improvements are still needed in processes used to produce tissue products, such as bath tissues, facial tissues and paper towels. The present disclosure is generally directed to tissue products having improved properties, especially in the cross-machine direction.

DEFINITIONS

A tissue product as described in this disclosure is meant to include paper products made from base webs such as bath tissues, facial tissues, paper towels, industrial wipers, food-service wipers, napkins, medical pads, and other similar products.

Pulp fibers, as used herein, include all known cellulosic fibers or fiber mixes comprising cellulosic fibers. Fibers suitable for making the webs of this disclosure comprise any natural cellulosic fibers including, but not limited to non-woody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898, issued Dec. 27, 1988, to Laamanen et al.; U.S. Pat. No. 4,594,130, issued Jun. 10, 1986, to Chang et al.; and U.S. Pat. No. 3,585,104. Useful fibers can also be produced by anthraquinone pulping, exemplified by U.S. Pat. No. 5,595,628, issued Jan. 21, 1997, to Gordon et al. A portion of the fiber furnish, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is Pulpex®, available from Hercules, Inc. (Wilmington, Del.). Any known bleaching method can be used. Synthetic cellulose fiber types include rayon in all its varieties and other fibers derived from viscose or chemically modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other pulp fibers that can be used in the present disclosure include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

Tensile Strength, Geometric Mean Tensile Strength (GMT), Tensile Energy Absorbed (TEA), and Percent Stretch:

The tensile test is performed using tissue samples that are conditioned at 23° C.+/−1° C. and 50%+/−2% relative humidity for a minimum of 4 hours. The samples are cut into 3 inch wide strips in the machine direction (MD) and cross-machine direction (CD) using a precision sample cutter model JDC 15M-10, available from Thwing-Albert Instruments, a business having offices located in Philadelphia, Pa., U.S.A.

The gauge length of the tensile frame is set to 4 inches. The tensile frame may be an Alliance RT/1 frame run with TestWorks 4 software. The tensile frame and the software are available from MTS Systems Corporation, a business having offices located in Minneapolis, Minn., U.S.A.

A 3" strip is then placed in the jaws of the tensile frame and subjected to a strain of 10 inches per minute until the point of sample failure. The stress on the tissue strip is monitored as a function of the strain. The calculated outputs include the peak load (grams-force/3", measured in grams-force), the peak stretch (%, calculated by dividing the elongation of the sample by the original length of the sample and multiplying by 100%), the % stretch @ 500 grams-force, the tensile energy absorption (TEA) at break (grams-force*cm/cm$^2$, calculated by integrating or taking the area under the stress-strain curve up to 70% of sample failure), and the slope A (kilograms-force, measured as the slope of the stress-strain curve from 57-150 grams-force).

Each tissue code (minimum of five replicates) is tested in the machine direction (MD) and cross-machine direction (CD). Geometric means of the tensile strength and tensile energy absorption (TEA) are calculated as the square root of the product of the machine direction (MD) and the cross-machine direction (CD). This yields an average value that is independent of testing direction.

Machine Direction Slope A or Cross-Machine Direction Slope A is a measure of the stiffness of a sheet and is also referred to as elastic modulus. The slope of a sample in the machine direction or the cross-machine direction is a measure of the slope of a stress-strain curve of a sheet taken during a test of tensile testing (see tensile strength definition above) and is expressed in units of grams of force. In particular, the slope A is taken as the least squares fit of the data between stress values of 70 grams of force and 157 grams of force.

Cross-Machine Direction Tensile/Cross-Machine Direction Stretch is the amount of tensile strength needed to generate 1% of stretch in the sample in the cross-machine direction. This value is calculated by taking the cross-machine direction peak load and dividing it by the stretch obtained at 500 grams force or peak load whichever is lower.

Cross-Machine Direction Tensile Energy Absorbed/Cross-Machine Direction Stretch is the amount of tensile energy absorbed needed to create 1% of stretch. This value is calculated by dividing the tensile energy absorbed in the cross-machine direction by the stretch of the sample in the cross-machine direction.

The bulk is calculated as the quotient of the caliper of a dry tissue sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

SUMMARY OF THE INVENTION

The present disclosure is generally directed to tissue products having enhanced cross-machine directional properties. These properties include relatively high peak stretch, relatively low slope, and increased tensile energy absorbed in the cross-machine direction. Thus, products made according to the present disclosure have relatively low stiffness with increased extensibility at relatively high strength levels.

The present inventors have discovered that the above properties can be obtained particularly on uncreped through-air dried webs. Further, the properties can be obtained without having to apply any bonding materials or binders to the surfaces of the web or to otherwise incorporate such materials into the web. In accordance with the present disclosure, the webs are formed in a through-air drying process in which a transfer fabric and a through-air drying fabric are both textured fabrics having a substantially uniform high strain distribution in the cross-machine direction. In the past, the transfer fabric tended to be more smooth and less textured than the through-air drying fabric.

In one embodiment, the present disclosure is directed to a single ply tissue product that comprises a tissue web containing pulp fibers. For instance, the tissue web may contain pulp fibers in an amount greater than about 50% by weight, such as in an amount greater than about 90% by weight. The tissue web may have a dry bulk of at least about 3 cc/g, such as at least about 8 cc/g, such as at least about 10 cc/g. In accordance with the present disclosure, the tissue web may have a geometric mean tensile strength of less than about 1,000 g/3 in, such as less than about 900 g/3 in, such as less than about 700 g/3 in. At these strength levels, the tissue web can have a cross-machine direction stretch of greater than about 11%, such as greater than about 13%, such as greater than about 15%. The cross-machine directional slope A of the product can be less than about 3 kg, such as less than about 2.5 kg. The cross-machine direction tensile/cross-machine directional stretch can be less than about 50, such as less than about 30. The cross-machine directional tensile energy absorbed/cross-machine directional stretch, on the other hand, can be less than about 0.4, such as less than about 0.35, such as less than about 0.3.

In one embodiment, the tissue web may comprise an uncreped through-air dried web. For instance, the web may be formed in a wetlaid through-air dried process. During the process, the web can be conveyed on a transfer fabric positioned immediately upstream from a through-air dryer. From the transfer fabric, the web may be transferred to a through-air dryer fabric that is configured to convey the web through the through-air dryer. In order to obtain the above properties, both the transfer fabric and the through-air dryer fabric may comprise textured fabrics having a machine direction dominant design.

For instance, the transfer fabric and the through-air dryer fabric may comprise multi-layered fabrics having from about 5 to about 15 raised elements per centimeter, such as from about 9 to about 11 raised elements per centimeter in the machine direction. The raised elements may have a height of from about 0.3 mm to about 5 mm, such as from about 0.3 mm to about 1 mm, such as from about 0.3 mm to about 0.5 mm. The raised elements may comprise ridges that have a width of from about 0.3 mm to about 1 mm. When viewed in the cross-machine direction, the ridges may have a sinusoidal ridge frequency of from about 0.5 mm to about 2 mm.

While being conveyed on at least one of the transfer fabric or the through-air dryer fabric, the tissue web may be molded against the fabric which has been found to enhance the properties of the web, especially in the cross-machine direction.

In one embodiment, the tissue product can demonstrate improved properties even in relation to many commercially available two-ply products. For instance, in one embodiment, the tissue product may have a cross-machine directional stretch of greater than about 15%, while having a cross-machine direction tensile/cross-machine direction stretch of less than about 30 and a cross-machine directional TEA/cross-machine directional stretch of less than about 0.4. The tissue product can also have a cross-machine direction slope of less than about 3 kg at geometric mean tensile strengths of less than about 1,000 g/3 in, such as less than about 700 g/3 in, such as less than about 500 g/3 in.

Other features and aspects of the present disclosure are discussed in greater detail below.

BRIEF DESCRIPTION OF THE DRAWINGS

A full and enabling disclosure of the present disclosure, including the best mode thereof to one of ordinary skill in the art, is set forth more particularly in the specification, including reference to the accompanying Figures in which.

Figure 1:
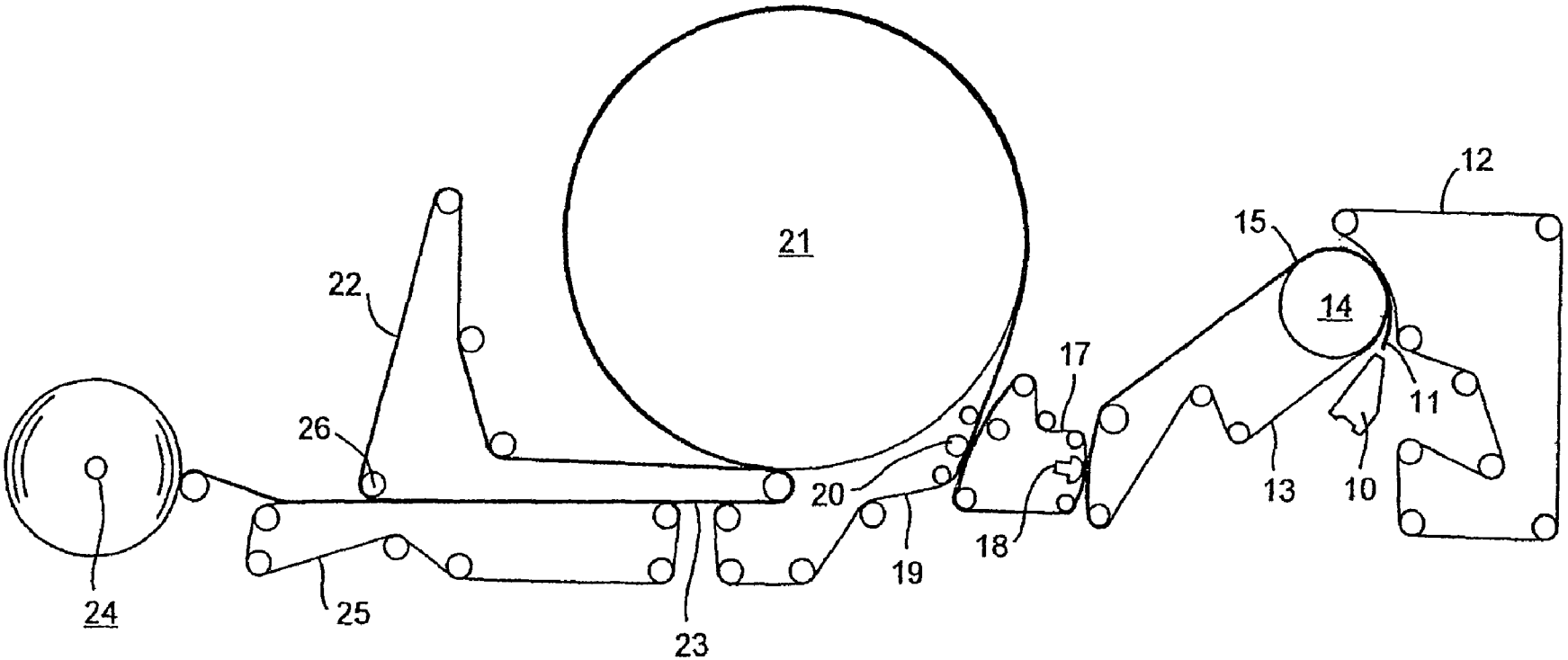
FIG. 1 is a cross-sectional view of one embodiment of a process for making tissue webs in accordance with the present disclosure.

Repeat use of reference characters in the present specification and drawings is intended to represent the same or analogous features or elements of the present disclosure.

DETAILED DESCRIPTION

It is to be understood by one of ordinary skill in the art that the present discussion is a description of exemplary embodiments only, and is not intended as limiting the broader aspects of the present disclosure, which broader aspects are embodied in the exemplary construction.

In general, the present disclosure is directed to tissue products having a unique combination of properties and to a process for producing the products. More particularly, tissue products made according to the present disclosure have enhanced properties especially in the cross-machine direction or the width direction of the tissue web as it is formed during a tissue making process. Tissue products made according to the present disclosure may comprise single ply products or multiple ply products, such as two-ply products. Such tissue products may include bath tissues and facial tissues. Paper towels, napkins, and other similar products may also be produced.

Tissue webs made according to the present disclosure generally comprise uncreped through-air dried webs. In order to produce the webs with the enhanced properties, the tissue web is conveyed through the through-air drying process using a transfer fabric immediately upstream from a through-air drying fabric in which both fabrics comprise substantially uniform and highly strained fabrics. For instance, the fabrics may have a uniform cross-machine direction strain distribution with from about 5% to about 25% cross-machine direction path-length strain, such as from about 10% to about 20% cross-machine direction path-length strain. In one particular embodiment, for instance, the fabric may have a path-length strain in the cross-machine direction of approximately 15%.

As described above, tissue webs made according to the present disclosure have enhanced properties, especially in the cross-machine direction. For instance, the tissue webs have relatively low stiffness, have increased extensibility and have enhanced durability all in the cross-machine direction.

For example, in one embodiment, a tissue web may be made according to the present disclosure that has, at a geometric mean tensile strength (GMT) of less than about 1,000 g/3 in, such as less than about 700 g/3 in, such as less than about 500 g/3 in, and a cross-machine stretch of at least about 11%, such as at least about 13%, such as at least about 15%. Additionally, the tissue web may have a cross-machine direction tensile strength/cross-machine direction stretch of less than about 50, such as less than about 40, such as less than about 30, which indicates the amount of grams tensile strength in order to obtain 1% of stretch.

The tissue webs may also have a cross-machine direction tensile energy absorbed (TEA)/cross-machine direction stretch of less than about 0.4, such as less than about 0.3. In addition to having improved stretch and strength characteristics in the cross-machine direction, the products also exhibit relatively low stiffness. For instance, the products can have a cross-machine direction slope of less than about 3 kg, such as less than about 2.5 kg.

The basis weight of tissue products made in accordance with the present disclosure can vary depending upon the particular application and whether or not the product is a single ply product or a multiple ply product. For single ply products, for instance, the basis weight of the products can be from about 15 gsm to about 45 gsm. For multiple ply products, on the other hand, the basis weight can be from about 15 gsm to about 50 gsm. As stated above, such products have a geometric mean tensile strength of generally less than about 1,000 g/3 in and are particularly well suited for producing facial tissues and bath tissues. The tissue product may be sold to consumers as a spirally wound product or may be sold to consumers as separately stacked sheets.

The tissue products can also be produced with the above properties while also minimizing the presence of pinholes. The degree to which pinholes are present can be quantified by the Pinhole Coverage Index, the Pinhole Count Index and the Pinhole Size Index, all of which are determined by an optical test method known in the art and described in U.S. Patent Application No. US 2003/0157300 A1 to Burazin, et al. entitled "Wide Wale Tissue Sheets and Method of Making Same", published on Aug. 21, 2003, and which is incorporated herein by reference. More particularly the "Pinhole Coverage Index" is the arithmetic mean percent area of the sample surface area, viewed from above, which is covered or occupied by pinholes. Tissue webs made according to the present disclosure can have a Pinhole Coverage Index of about 0.25 or less, such as from about 0.20 or less, such as from about 0.15 or less, and, in one embodiment, from about 0.05 to about 0.15.

The "Pinhole Count Index" is the number of pinholes per 100 square centimeters that have an equivalent circular diameter (ECD) greater than 400 microns. Webs made according to the present disclosure can have a Pinhole Count Index of about 65 or less, such as about 60 or less, such as about 50 or less, such as about 40 or less, and, in one embodiment, from about 5 to about 50, such as from about 5 to about 40.

The "Pinhole Size Index" is the mean equivalent circular diameter (ECD) for all pinholes having an ECD greater than 400 microns. For webs made according to the present disclosure, the Pinhole Size Index can be about 600 or less, such as about 500 or less, such as from about 400 to about 600, such as from about 450 to about 550.

Base webs that may be used in the process of the present disclosure can vary depending upon the particular application. For instance, the webs can be made from any suitable type of fiber. For example, the base web can be made from pulp fibers, other natural fibers, synthetic fibers, and the like.

Pulp fibers useful for purposes of this disclosure include any cellulosic fibers which are known to be useful for making tissue products, particularly those fibers useful for making relatively low density webs such as facial tissue, bath tissue, paper towels, dinner napkins and the like. Suitable fibers include virgin softwood and hardwood fibers, as well as secondary or recycled cellulosic fibers, and mixtures thereof. Especially suitable hardwood fibers include eucalyptus and maple fibers. As used herein, secondary fibers means any cellulosic fiber which has previously been isolated from its original matrix via physical, chemical or mechanical means and, further, has been formed into a fiber web, dried to a moisture content of about 10 weight percent or less and subsequently reisolated from its web matrix by some physical, chemical or mechanical means.

Tissue webs made in accordance with the present invention can be made with a homogeneous fiber furnish or can be formed from a stratified fiber furnish producing layers within the single ply product. Stratified base webs can be formed using equipment known in the art, such as a multi-layered headbox. Both strength and softness of the base web can be adjusted as desired through layered tissues, such as those produced from stratified headboxes.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present invention includes a first outer layer and a second outer layer containing primarily hardwood fibers. The hardwood fibers can be mixed, if desired, with paper broke in an amount up to about 30% by weight and/or softwood fibers in an amount up to about 30% by weight. The base web further includes a middle layer positioned in between the first outer layer and the second outer layer. The middle layer can contain primarily softwood fibers. If desired, other fibers, such as high-yield fibers or synthetic fibers may be mixed with the softwood fibers.

When constructing a web from a stratified fiber furnish, the relative weight of each layer can vary depending upon the particular application. For example, in one embodiment, when constructing a web containing three layers, each layer can be from about 15% to about 50% of the total weight of the web, such as from about 25% to about 35% of the weight of the web.

The tissue web can contain pulp fibers and can be formed in a wet-lay process incorporating a through-air dryer. In a wet-lay process, the fiber furnish is combined with water to form an aqueous suspension. The aqueous suspension is spread onto a wire or felt and dried to form the web.

In one embodiment, the base web is formed by an uncreped through-air drying process. More particularly, according to the present disclosure, a textured and highly strained transfer fabric and a similar textured and highly strained through-air drying fabric are used in the process during production of the webs and contributes to the improved and unique properties obtained. Referring to FIG. 1, a schematic process flow diagram illustrating a method of making uncreped throughdried sheets in accordance with this embodiment is illustrated. Shown is a twin wire former having a papermaking headbox 10 which injects or deposits a stream 11 of an aqueous suspension of papermaking fibers onto the forming fabric 13 which serves to support and carry the newly-formed wet web downstream in the process as the web is partially dewatered to a consistency of about 10 dry weight percent. Specifically, the suspension of fibers is deposited on the forming fabric 13 between a forming roll 14 and another dewatering fabric 12. Additional dewatering of the wet web can be carried out, such as by vacuum suction, while the wet web is supported by the forming fabric.

The wet web is then transferred from the forming fabric to a transfer fabric 17 traveling at a slower speed than the forming fabric in order to impart increased stretch into the web. Transfer is preferably carried out with the assistance of a vacuum shoe 18 and a kiss transfer to avoid compression of the wet web. If desired, the web may be transferred against the transfer fabric 17 under sufficient pressure to cause the sheet to conform to the fabric.

The web is then transferred from the transfer fabric to the throughdrying fabric 19 with the aid of a vacuum transfer roll 20 or a vacuum transfer shoe. The throughdrying fabric can be traveling at about the same speed or a different speed relative to the transfer fabric. If desired, the throughdrying fabric can be run at a slower speed to further enhance stretch. Transfer is preferably carried out with vacuum assistance to ensure deformation of the sheet to conform to the throughdrying fabric, thus yielding desired bulk and appearance.

As described above, in accordance with the present disclosure, the process is carried out such that both the transfer fabric 17 and the through-air drying fabric 19 comprise textured fabrics having a substantially uniform cross-machine direction strain distribution. For instance, the fabrics can have a cross-machine direction path-length strain of from about 10% to about 20%, such as from about 14% to about 16%.

Suitable textured or 3-dimensional fabrics that may be used as the transfer fabric and the through-air drying fabric are fabrics that can include a top surface and a bottom surface. During molding and/or through-air drying, the top surface supports the wet tissue web. The wet tissue web conforms to the top surface and during molding is strained into a 3-dimensional topographic form corresponding to the 3-dimensional topography of the top surface of the fabric. Adjacent the bottom surface, the fabric can have a load-bearing layer which integrates the fabric and provides a relatively smooth surface for contact with various tissue machine elements.

The transfer fabric and the through-air drying fabric, for instance, may have textured sheet-contacting surfaces comprising substantially continuous machine-direction ridges separated by valleys (see, for instance, U.S. Patent Application No. 2003/0157300 A1 to Burazin, et al., which is incorporated herein by reference).

Figure 2:
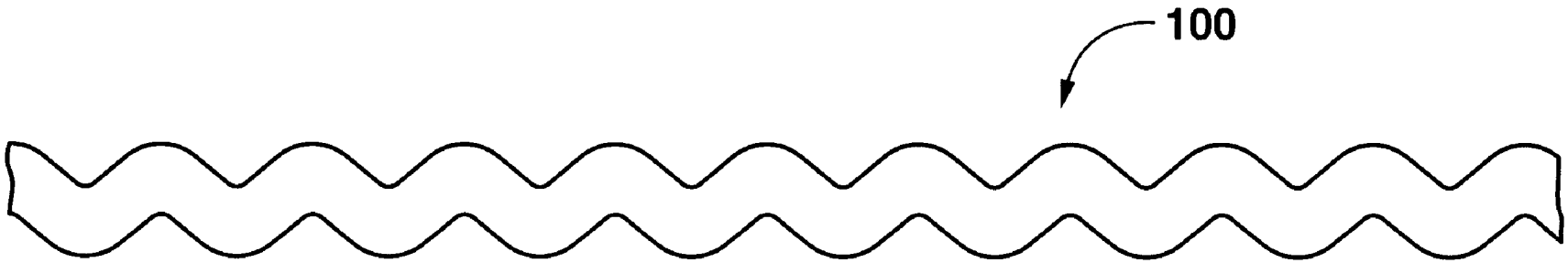
FIG. 2 is a cross-sectional view in the cross-machine direction of an exemplary illustration showing one embodiment of a transfer fabric that may be used in the process of the present disclosure.

For instance, both fabrics can have a machine-direction dominant design comprising from about 5 to about 15 raised elements per centimeter in the machine direction, such as from about 9 to about 11 raised elements per centimeter. The raised elements may have a height of from about 0.3 mm to about 5 mm, such as from about 0.3 mm to about 1 mm, such as from about 0.3 mm to about 0.5 mm. The raised elements may comprise ridges that have a width of from about 0.3 mm to about 1 mm. A cross-machine direction line trace of the fabric, for instance, may have the approximate structure of a wave, such as a sine wave. For example, referring to FIG. 2, for exemplary purposes only, a cross section of a fabric 100 in the cross-machine direction is shown illustrating the structure of a wave. For fabrics used in accordance with the present disclosure, the wave can have an amplitude of from about 0.3 mm to about 0.7 mm, such as about 0.5 mm and a frequency of from about 0.5 mm to about 2 mm, such as about 1 mm.

In one embodiment, both the transfer fabric and the through-air drying fabric may comprise the same fabric or a different but similar fabric. In one particular embodiment, the transfer fabric and the through-air drying fabric comprise the t-1207-6 fabric obtained from Voith Fabrics, Inc.

The use of textured and highly strained fabrics as described above in both the transfer fabric position and the through-air drying fabric position has unexpectedly produced products having a unique combination of properties and improved characteristics, especially in the cross-machine direction. In the past, many conventional processes used a transfer fabric that had a relatively smooth surface (less textured than the throughdrying fabric) in order to impart smoothness to the web. The present inventors, however, have discovered that using a textured and highly strained fabric as described above may provide various benefits and advantages.

The level of vacuum used for the web transfers can be, for instance, from about 3 to about 25 inches of mercury, such as about 6 inches of mercury to about 15 inches of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is dried to a consistency of about 94 percent or greater by the throughdryer 21 and thereafter transferred to a carrier fabric 22. The dried basesheet 23 is transported to the reel 24 using carrier fabric 22 and an optional carrier fabric 25. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern.

Softening agents, sometimes referred to as debonders, can be used to enhance the softness of the tissue product and such softening agents can be incorporated with the fibers before, during or after formation of the aqueous suspension of fibers. Such agents can also be sprayed or printed onto the web after formation, while wet. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di (hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

In order to provide stretch to the tissue in the machine direction, a speed differential may be provided between fabrics at one or more points of transfer of the wet web. This process is known as rush transfer. The speed difference between the fabrics can be from about 5 to about 75 percent or greater, such as from about 10 to about 35 percent. For instance, in one embodiment, the speed difference can be from about 20 to about 30 percent, based on the speed of the slower fabric. The optimum speed differential will depend on a variety of factors, including the particular type of product being made. As previously mentioned, the increase in stretch imparted to the web is proportional to the speed differential. For a single-ply uncreped throughdried bath tissue having a basis weight of about 30 grams per square meter, for example, a speed differential of from about 20 to about 30 percent between the forming fabric and a transfer fabric produces a stretch in the machine direction in the final product of from about 15 to about 25 percent. The stretch can be imparted to the web using a single differential speed transfer or two or more differential speed transfers of the wet web prior to drying. Hence there can be one or more transfer fabrics. The amount of stretch imparted to the web can hence be divided among one, two, three or more differential speed transfers.

The web is transferred to the throughdrying fabric for final drying preferably with the assistance of vacuum to ensure macroscopic rearrangement of the web to give the desired bulk and appearance.

As described above, webs made according to the process of the present disclosure possess a combination of unique properties especially in the cross-machine direction. It may be possible to obtain these properties by applying a flexible binder to the web as it is produced. As used herein, a "binder" refers to any suitable bonding agent that is applied to a tissue web for bonding the web together and may include materials, such as ethylene vinyl acetate copolymers and the like. The properties of webs made according to the present disclosure, however, are produced without having to apply a binder to either surface of the web.

After the web is formed and dried, the tissue product of the present disclosure may undergo a converting process where the formed base web is prepared for final packaging. For instance, in one embodiment, the tissue web may be spirally wound into rolls to produce, for instance, a bath tissue product. Alternatively, the tissue web may be cut into sheets to serve as a bath tissue product or a facial tissue product. In one embodiment, the tissue web may be combined with another web to produce a two-ply tissue product.

The following example is intended to illustrate particular embodiments of the present disclosure without limiting the scope of the appended claims.

Example

An uncreped through-dried bath tissue was produced similar to the process illustrated in FIG. 1. In accordance with the present disclosure, the transfer fabric immediately upstream from the through-air dryer and the following through-air dryer fabric were both a t-1207-6 fabric obtained from Voith Fabrics, Inc.

The base web was made of about 28 to 29% Northern Softwood Kraft (NSWK) and about 71 to 72% Kraft eucalyptus, which was layered as follows: 36% eucalyptus/28% NSWK/36% eucalyptus by weight.

The eucalyptus was treated with 1.75 kg/mt active debonder and the NSWK was refined between 0 and 2.5 HPD/T with 5 kg/mt of PAREZ wet strength resin added.

The tissue was vacuum dewatered to approximately 26-28% consistency prior to entering the through-air dryer and then dried in the through-air dryer to approximately 1% final moisture prior to winding of the parent rolls.

Eleven different tissue samples made according to the above process were prepared and tested for various properties. Also, numerous bath tissue products obtained worldwide were also tested. The following results were obtained:

| Manufacturer | Brand | Sub-Brand | Plies (number) | BD Basis Weight (gsm) | MD-Dry Tensile (gm/76.2 mm) | CD-DRY Tensile (gm/76.2 mm) | MD/CD Ratio | GMT (gm/76.2 mm) |
|---|---|---|---|---|---|---|---|---|
| | Sample 1 | Code 220 | 1 | 28.1 | 907 | 284 | 3.2 | 507 |
| | Sample 2 | Code 4 | 1 | 28.3 | 896 | 451 | 2.0 | 636 |
| | Sample 3 | Code 6 | 1 | 29.3 | 1037 | 565 | 1.8 | 766 |
| | Sample 4 | Code 219 | 1 | 28 | 812 | 315 | 2.6 | 506 |
| | Sample 5 | Code 218 | 1 | 27.9 | 759 | 350 | 2.2 | 516 |
| | Sample 6 | Code 64 | 1 | 28.1 | 896 | 538 | 1.7 | 695 |
| | Sample 7 | Code 65 | 1 | 27.8 | 883 | 509 | 1.7 | 671 |
| | Sample 8 | Code 5 | 1 | 28.5 | 940 | 480 | 2.0 | 672 |
| | Sample 9 | Code 66 | 1 | 29.2 | 1198 | 676 | 1.8 | 900 |
| | Sample 10 | Code 67 | 1 | 29 | 1157 | 654 | 1.8 | 870 |
| | Sample 11 | Code 217 | 1 | 27.2 | 701 | 387 | 1.8 | 521 |
| Kimberly-Clark | Classic | | 2 | 30.73 | 918 | 391 | 2.3 | 599 |
| SCA | Sorbent | Orginal | 2 | 28.8 | 1948 | 467 | 4.2 | 954 |
| Kimberly-Clark | Petalo | Sensations | 1 | 31.00 | 851 | 605 | 1.4 | 718 |
| Melhoramentos | Fofura | | 2 | 27.92 | 906 | 311 | 2.9 | 531 |
| Kimberly-Clark | Lys | | 2 | 29.43 | 886 | 381 | 2.3 | 581 |
| Kimberly-Clark | Cottenelle | Dilbert | 1 | 28.87 | 670 | 501 | 1.3 | 579 |
| Kimberly-Clark | Scottex | double roll | 2 | 29.30 | 1487 | 724 | 2.1 | 1038 |
| Kimberly-Clark | Kleenex | | 1 | 32.1 | 984 | 668 | 1.5 | 811 |
| Kimberly-Clark | Kerlisu | | 2 | 31.42 | 1365 | 567 | 2.4 | 880 |
| Kimberly-Clark | Cottenelle | Ironman 1.2 | 1 | 27.5 | 724 | 489 | 1.5 | 595 |
| GP | Kirkland Signature | | 2 | 30.7 | 1193 | 427 | 2.8 | 714 |
| P&G | Charmin | | 1 | 29.9 | 671 | 461 | 1.5 | 556 |
| Kimberly-Clark | Kleenex | Printed | 2 | 31.3 | 1127 | 496 | 2.3 | 748 |
| Kimberly-Clark | Cottenelle | Linea Dorada | 2 | 31.80 | 1208 | 931 | 1.3 | 1060 |
| P&G | Charmin | Ultra | 2 | 43.1 | 694 | 513 | 1.4 | 597 |
| Kimberly-Clark | Popee | Plus | 2 | 31.42 | 1536 | 583 | 2.6 | 946 |
| | Albert Heijn | mainline | 2 | 36.80 | 1541 | 476 | 3.2 | 856 |
| P&G | Charmin | Plus | 1 | 35.7 | 721 | 515 | 1.4 | 609 |
| P&G | Codi | | 2 | 26.97 | 1350 | 521 | 2.6 | 839 |
| Nibong Tebal | Royal Gold | | 3 | 44.80 | 2689 | 569 | 4.7 | 1237 |
| Kimberly-Clark | Cottenelle | Aloe & E | 1 | 33.7 | 804 | 632 | 1.3 | 713 |
| Kimberly-Clark | Page | mainline | 1 | 33.40 | 1134 | 956 | 1.2 | 1041 |
| Monalisa | Good Morning | | 2 | 28.26 | 1573 | 470 | 3.3 | 860 |
| GP | Northern | | 2 | 33.0 | 941 | 398 | 2.4 | 612 |
| Papeles Nacionales | Joya | Economico | 2 | 28.39 | 1585 | 411 | 3.9 | 807 |
| Kimberly-Clark | Cottenelle | Ultra | 2 | 44.3 | 1055 | 700 | 1.5 | 859 |
| Kimberly-Clark | Scottex | mainline | 2 | 30.50 | 1574 | 708 | 2.2 | 1056 |
| Kimberly-Clark | Fiesta | — | 1 | 20.62 | 1063 | 438 | 2.4 | 682 |
| Kimberly-Clark | Scottex | mainline | 2 | 37.2 | 1536 | 486 | 3.2 | 864 |
| Kimberly-Clark | Kleenex | | 2 | 32.96 | 1444 | 475 | 3.0 | 828 |
| Kimberly-Clark | Kirkland Signature | Evt #1 | 2 | 30.5 | 1253 | 448 | 2.8 | 749 |
| Kimberly-Clark | Member's Mark | | 2 | 29.2 | 1302 | 513 | 2.5 | 817 |
| Kimberly-Clark | Carlton | 1-Ply | 1 | 17.67 | 1343 | 440 | 3.1 | 769 |
| Cimic | Hygienix | | 2 | 30.83 | 1538 | 534 | 2.9 | 906 |
| Kimberly-Clark | Kirkland Signature | Evt #3 | 2 | 31.4 | 1016 | 471 | 2.2 | 692 |
| Metsa/Soffass | Soft & Easy | | 2 | 30.29 | 2297 | 612 | 3.8 | 1186 |
| Kimberly-Clark | Tiss Soff | | 2 | 28.59 | 1580 | 717 | 2.2 | 1064 |
| GP | Angel Soft | | 2 | 35.1 | 1490 | 454 | 3.3 | 822 |
| Nibong Tebal | Cutie | Soft | 2 | 42.41 | 1967 | 714 | 2.8 | 1185 |
| Berli Jucker Cellox | Cellox | | 2 | 28.72 | 1657 | 579 | 2.9 | 979 |
| Kimberly-Clark | WalMart | Great Value | 2 | 28.79 | 1514 | 548 | 2.8 | 911 |
| Nampak | Twinsaver | 1-Ply | 1 | 19.09 | 1244 | 558 | 2.2 | 833 |
| Copamex | Regio | | 2 | 30.10 | 1242 | 449 | 2.8 | 747 |
| Yung feng yu | Mayflower | | 2 | 32.67 | 2471 | 539 | 4.6 | 1154 |
| Tronchetti | Foxy | Super Soft | 2 | 30.60 | 1788 | 650 | 2.8 | 1078 |
| Kimberly-Clark | Andrex | | 2 | 32.90 | 1403 | 622 | 2.3 | 934 |
| GP | Walgreen | 1000 | 1 | 17.7 | 1139 | 435 | 2.6 | 704 |
| Kimberly-Clark | Velvet | | 2 | 34.33 | 3468 | 934 | 3.7 | 1800 |
| Kimberly-Clark | Scott | Deluxe | 2 | 28.54 | 1245 | 524 | 2.4 | 808 |
| Delicarta | Aldi Solo | 3-ply | 3 | 44.20 | 2369 | 598 | 4.0 | 1190 |
| Nampak | Twinsoft | 2 Ply | 2 | 30.12 | 1300 | 639 | 2.0 | 911 |

-continued

| Manufacturer | Brand | Sub-Brand | Plies (number) | BD Basis Weight (gsm) | MD-Dry Tensile (gm/76.2 mm) | CD-DRY Tensile (gm/76.2 mm) | MD/CD Ratio | GMT (gm/76.2 mm) |
|---|---|---|---|---|---|---|---|---|
| Kimberly-Clark | Sujay | | 3 | 43 | 2597 | 847 | 3.1 | 1483 |
| Kimberly-Clark | Wondersoft | | 2 | 29.5 | 1088 | 736 | 1.5 | 895 |
| Kimberly-Clark | Scott | Extra | 2 | 33.06 | 1604 | 688 | 2.3 | 1051 |
| SCA | Sorbent | Extra Thick | 3 | 41.7 | 2401 | 720 | 3.3 | 1315 |
| Kimberly-Clark | Scottenelle | | 2 | 37.6 | 1387 | 668 | 2.1 | 963 |
| Kimberly-Clark | Scott | Gold | 2 | 29.90 | 1188 | 493 | 2.4 | 765 |
| Delitissue | Regina | | 2 | 39.86 | 3029 | 878 | 3.4 | 1631 |
| P&G | Charmin | Basic | 1 | 26.43 | 1198 | 580 | 2.1 | 834 |
| Nibong Tebal | Cutie | Compact | 2 | 38.92 | 2556 | 620 | 4.1 | 1259 |
| Tien Long Paper | Andante | | 2 | 33.00 | 1494 | 675 | 2.2 | 1004 |
| Papeles Nacionales | Suave | Premium Gold | 2 | 38.50 | 1122 | 451 | 2.5 | 711 |
| Potlatch | Albertson's | | 1 | 17.3 | 1196 | 527 | 2.3 | 794 |
| GP | Colhogar | mainline | 2 | 38.7 | 1631 | 515 | 3.2 | 916 |
| Kimberly-Clark | Flamingo | | 2 | 32.80 | 1994 | 535 | 3.7 | 1033 |
| Kimberly-Clark | Scott | 1-ply | 1 | 17.87 | 1213 | 529 | 2.3 | 801 |
| P&G | Charmin | Comfort | 2 | 39.7 | 1600 | 971 | 1.6 | 1246 |
| P&G | Charmin | Suave Aroma | 2 | 33.40 | 1425 | 632 | 2.3 | 949 |
| Delitissue | Regina | | 3 | 44.5 | 3124 | 868 | 3.6 | 1647 |
| ICT | Foxy | Super Soft | 2 | 34.6 | 1980 | 830 | 2.4 | 1282 |
| CMPC | Elite | Diseno 2-ply | 2 | 28.13 | 1094 | 486 | 2.3 | 729 |
| Kimberly-Clark | KleenexSujay | | 2 | 33.61 | 1751 | 898 | 1.9 | 1254 |
| PT Pindo Deli | Paseo | | 3 | 43.20 | 1796 | 815 | 2.2 | 1210 |
| Carrara | Migros Soft | 3-ply | 3 | 50.6 | 2943 | 948 | 3.1 | 1670 |
| Kimberly-Clark | Andrex | POAR | 2 | 41.8 | 2613 | 733 | 3.6 | 1384 |
| Eroski | Linder | mainline | 2 | 30.5 | 1608 | 694 | 2.3 | 1056 |
| Kimberly-Clark | Scott | Select | 2 | 27.21 | 2357 | 853 | 2.8 | 1418 |
| GP | Tenderly | DermaSoft | 2 | 35.80 | 1393 | 499 | 2.8 | 834 |
| GP | Northern | Ultra | 2 | 39.3 | 1072 | 429 | 2.5 | 678 |
| Copamex | Flen | | 2 | 28.16 | 2651 | 821 | 3.2 | 1475 |
| | Dollar General | | 2 | 32.8 | 1515 | 688 | 2.2 | 1021 |
| Kimberly-Clark | Kleenex | Care | 2 | 31.50 | 2091 | 683 | 3.1 | 1195 |
| Sano | SanoSoft | | 2 | 30.53 | 1836 | 893 | 2.1 | 1280 |
| | Clean & Soft | International | 3 | 36.70 | 2465 | 861 | 2.9 | 1457 |
| Kimberly-Clark | Andrex | mainline | 2 | 44.1 | 1945 | 651 | 3.0 | 1125 |
| Kimberly-Clark | Scott | Plus Mas Metros | 2 | 27.21 | 1334 | 667 | 2.0 | 943 |
| Kimberly-Clark | Scott | Natural | 2 | 28.4 | 1335 | 669 | 2.0 | 945 |
| Kimberly-Clark | Neve | Neutro | 2 | 28.21 | 1937 | 731 | 2.6 | 1190 |
| Kimberly-Clark | Sujay | | 2 | 34.33 | 1159 | 721 | 1.6 | 914 |
| Kimberly-Clark | Scott | Extra | 2 | 29.01 | 1925 | 832 | 2.3 | 1266 |
| DaeHan Pulp | K-Nara | | 2 | 28.49 | 1537 | 736 | 2.1 | 1064 |
| Kimberly-Clark | Tiss | — | 2 | 30.94 | 1818 | 850 | 2.1 | 1243 |
| | Coop Italia | mainline | 2 | 31.50 | 2208 | 748 | 3.0 | 1285 |
| Kimberly-Clark | Kleenex | Care | 2 | 32.80 | 1286 | 766 | 1.7 | 993 |
| Santher | Personal | 1-ply | 1 | 19.64 | 1785 | 913 | 2.0 | 1277 |
| Santher | Personal | Premium | 2 | 26.59 | 1408 | 670 | 2.1 | 971 |
| P&G | Charmin | Comfort | 2 | 42.00 | 2107 | 1217 | 1.7 | 1601 |
| Kimberly-Clark | Molett | | 2 | 31.54 | 1740 | 832 | 2.1 | 1203 |
| Kimberly-Clark | Kleenex | Baby Soft | 2 | 30.03 | 1584 | 725 | 2.2 | 1072 |
| P&G | Charmin | | 2 | 34.20 | 1322 | 684 | 1.9 | 951 |
| Kimberly-Clark | Delsey | | 2 | 28.67 | 1713 | 776 | 2.2 | 1153 |
| Kimberly-Clark | Kleenex | Boutique | 2 | 37.45 | 1233 | 598 | 2.1 | 859 |
| ABC Tissue Products | Quilton | | 3 | 49.5 | 2014 | 781 | 2.6 | 1254 |
| Kimberly-Clark | Neve | Elegance | 2 | 29.63 | 1751 | 765 | 2.3 | 1157 |
| Papeles Nacionales | Suave | | 2 | 38.70 | 1346 | 592 | 2.3 | 893 |
| Irving | Soft Weve | | 1 | 15.4 | 1264 | 498 | 2.5 | 793 |
| Kimberly-Clark | Andrex | Ultra (for HK) | 3 | 42.73 | 1729 | 841 | 2.1 | 1206 |
| Kimberly-Clark | Suavel | | 2 | 28.08 | 1614 | 834 | 1.9 | 1160 |
| SCA | ASDA Shades | | 2 | 34.1 | 2461 | 1089 | 2.3 | 1637 |
| Familia Sancela | Familia | Ultra Suave | 2 | 30.24 | 1278 | 593 | 2.2 | 871 |
| Familia Sancela | Familia | Economico | 2 | 32.45 | 1729 | 766 | 2.3 | 1151 |
| Kimberly-Clark | Kleenex | Ultra Care | 3 | 44.10 | 1515 | 897 | 1.7 | 1166 |
| CMPC | Elite | Extra | 2 | 28.43 | 1919 | 1211 | 1.6 | 1524 |
| Kimberly-Clark | Nice | 1-ply | 1 | 20.03 | 1354 | 542 | 2.5 | 857 |
| Kimberly-Clark | Scott | Deluxe | 3 | 46.13 | 1865 | 913 | 2.0 | 1305 |
| GP | Tesco | mainline | 2 | 43.5 | 1823 | 743 | 2.5 | 1164 |
| Melhoramentos | Sublime | | 1 | 19.07 | 727 | 480 | 1.5 | 591 |
| | Carrefour | Classic | 2 | 29.40 | 3135 | 940 | 3.3 | 1717 |
| SCA | Carrefour | mainline | 2 | 38.7 | 2586 | 876 | 3.0 | 1505 |

-continued

| Manufacturer | Brand | Sub-Brand | Plies (number) | BD Basis Weight (gsm) | MD-Dry Tensile (gm/76.2 mm) | CD-DRY Tensile (gm/76.2 mm) | MD/CD Ratio | GMT (gm/76.2 mm) |
|---|---|---|---|---|---|---|---|---|
| Kimberly-Clark | Servus | 3-ply | 3 | 46.50 | 3020 | 1179 | 2.6 | 1887 |
| Kimberly-Clark | Fancy | | 2 | 31.08 | 1690 | 743 | 2.3 | 1121 |
| Kimberly-Clark | Scott | 1000 | 1 | 16.8 | 1326 | 581 | 2.3 | 878 |
| Copamex | Lady Regio | | 2 | 30.60 | 1861 | 963 | 1.9 | 1339 |
| P&G | Tender | | 2 | 33.06 | 1841 | 710 | 2.6 | 1143 |
| Kimberly-Clark | Hakle Kamille | 3-ply | 3 | 48.50 | 3506 | 1264 | 2.8 | 2105 |
| | Coop Super Soft | | 4 | 59.8 | 3821 | 1269 | 3.0 | 2202 |
| | Clean & Soft | C & S | 3 | 39.40 | 3225 | 947 | 3.4 | 1748 |
| Kimberly-Clark | Lily | | 2 | 35.03 | 1724 | 901 | 1.9 | 1246 |
| Delicarta | AS Schlecker | Premium | 4 | 56.30 | 2144 | 1142 | 1.9 | 1565 |
| Kimberly-Clark | Petalo | Classico | 2 | 29.50 | 2020 | 940 | 2.1 | 1378 |
| Kimberly-Clark | Kleenex | (Bahrain tissue) | 2 | 30.8 | 1225 | 674 | 1.8 | 909 |
| Familia Sancela | Familia | Cuidado | 2 | 39.69 | 1243 | 681 | 1.8 | 920 |
| Kimberly-Clark | Scott | Gold | 2 | 28.10 | 1219 | 770 | 1.6 | 969 |
| | Denner | | 4 | 56.4 | 3389 | 1248 | 2.7 | 2057 |
| Marcal | Marcal | | 1 | 16.9 | 1284 | 567 | 2.3 | 853 |
| Yuen Foong Yu | Mayflower | | 2 | 31.3 | 2019 | 796 | 2.5 | 1268 |
| Kimberly-Clark | Nice | Gold | 2 | 27.01 | 2302 | 774 | 3.0 | 1335 |
| APP group | Virjoy | 2-ply | 2 | 33.98 | 2885 | 1009 | 2.9 | 1706 |
| APP group | Virjoy | Premium | 3 | 42.30 | 2095 | 913 | 2.3 | 1383 |
| Productos Tissue del Peru | Noble | 1-ply | 1 | 19.49 | 1404 | 1304 | 1.1 | 1353 |
| Kimberly-Clark | Suave | Extra | 1 | 21.11 | 1230 | 825 | 1.5 | 1007 |
| Kimberly-Clark | Scott | Gold Ultra | 3 | 41.50 | 1633 | 1137 | 1.4 | 1363 |
| CMPC | Elite | Doble Hoja | 2 | 27.47 | 2181 | 977 | 2.2 | 1460 |
| Kimberly-Clark | Hakle Kamille | 3-ply | 3 | 47.7 | 3734 | 1560 | 2.4 | 2414 |
| GP | Zewa Lind | 3-ply | 3 | 48.70 | 2901 | 1008 | 2.9 | 1710 |
| SCA | Edet | Friendly | 3 | 44.30 | 3117 | 1146 | 2.7 | 1890 |
| Kimberly-Clark | Suave | Plus | 2 | 28.66 | 1529 | 1004 | 1.5 | 1239 |
| Kimberly-Clark | Kleenex | 500 | 2 | 28.41 | 2074 | 701 | 3.0 | 1206 |
| Metsa | Lambi | | 3 | 44.8 | 2597 | 1407 | 1.8 | 1912 |
| CMPC | Elite | 1-ply | 1 | 18.59 | 1344 | 867 | 1.6 | 1079 |
| Kimberly-Clark | Suave | Gold | 2 | 29.6 | 1486 | 917 | 1.6 | 1167 |
| GP | Lotus | Finesse | 2 | 38.50 | 2155 | 870 | 2.5 | 1369 |
| LIDL | Siempre | | 4 | 60.90 | 4058 | 1481 | 2.7 | 2452 |
| CMPC | Elite | Premium | 3 | 40 | 2759 | 1054 | 2.6 | 1705 |
| | Vinda | regular | 3 | 38.70 | 3147 | 948 | 3.3 | 1727 |
| | Migros Soft | Extra | 4 | 56.7 | 3379 | 1431 | 2.4 | 2199 |
| Soffass | Regina | Rotolini | 2 | 31.80 | 2013 | 986 | 2.0 | 1409 |
| APP group | Virjoy | Extra Soft | 3 | 41.90 | 2221 | 1057 | 2.1 | 1532 |
| | Favorita | Plus | 2 | 28.7 | 2065 | 868 | 2.4 | 1339 |
| SCA | Velvet | | 2 | 43.4 | 2311 | 898 | 2.6 | 1441 |
| Soffass | Regina | Cartacomomilla | 4 | 59.20 | 3117 | 1366 | 2.3 | 2063 |
| CMPC | Elite | con Oso | 2 | 27.7 | 2302 | 992 | 2.3 | 1511 |
| | Vinda | premium | 3 | 40.40 | 3162 | 964 | 3.3 | 1746 |
| Vinda | Vinda blue | | 3 | 40.02 | 3080 | 1042 | 3.0 | 1791 |
| | Aldi Kokett | | 4 | 58.10 | 3238 | 1306 | 2.5 | 2056 |
| Kimberly-Clark | Vogue | | 2 | 28.87 | 2156 | 923 | 2.3 | 1411 |
| Familia Sancela | Familia | Cuidado | 2 | 39.80 | 910 | 1023 | 0.9 | 965 |
| San Francisco | Hortensia | | 2 | 28.34 | 2405 | 1573 | 1.5 | 1945 |

| Manufacturer | Brand | Sub-Brand | Plies (number) | MD-Dry Stretch (%) | CD-DRY Stretch (%) | MD-Dry Slope (kg) | CD-DRY Slope (kg) | MD-Dry TEA (gm-cm/cm2) | CD-DRY TEA (gm/cm/cm2) |
|---|---|---|---|---|---|---|---|---|---|
| | Sample 1 | Code 220 | 1 | 15.3 | 13.63 | 6.13 | 1.92 | 10.53 | 3.34 |
| | Sample 2 | Code 4 | 1 | 16.7 | 14.6 | 6.08 | 2.19 | 11.48 | 4.94 |
| | Sample 3 | Code 6 | 1 | 18.8 | 16.3 | 15.2 | 2.2 | 18.8 | 6.22 |
| | Sample 4 | Code 219 | 1 | 14.54 | 12.8 | 6.28 | 2.2 | 9.16 | 3.46 |
| | Sample 5 | Code 218 | 1 | 13.72 | 12.64 | 6.07 | 2.32 | 8.58 | 3.65 |
| | Sample 6 | Code 64 | 1 | 17.6 | 15 | 5.74 | 2.35 | 12.6 | 5.36 |
| | Sample 7 | Code 65 | 1 | 17 | 14.5 | 6.38 | 2.35 | 12 | 5.12 |
| | Sample 8 | Code 5 | 1 | 15.6 | 14.4 | 11.6 | 2.4 | 15.6 | 5.01 |
| | Sample 9 | Code 66 | 1 | 18.3 | 15.4 | 6.79 | 2.44 | 16.5 | 6.6 |
| | Sample 10 | Code 67 | 1 | 17.5 | 14.7 | 8.13 | 2.55 | 15.6 | 6.5 |
| | Sample 11 | Code 217 | 1 | 13.92 | 11.91 | 5.97 | 2.6 | 8.23 | 3.75 |

-continued

| Manufacturer | Brand | Sub-Brand | Plies (number) | MD-Dry Stretch (%) | CD-DRY Stretch (%) | MD-Dry Slope (kg) | CD-DRY Slope (kg) | MD-Dry TEA (gm-cm/cm2) | CD-DRY TEA (gm/cm/cm2) |
|---|---|---|---|---|---|---|---|---|---|
| Kimberly-Clark | Classic | | 2 | 16.95 | 12.87 | 5.66 | 3.19 | 13.08 | 6.62 |
| SCA | Sorbent | Orginal | 2 | 15.18 | 14.76 | 7.85 | 4.00 | 21.40 | 9.35 |
| Kimberly-Clark | Petalo | Sensations | 1 | 16.34 | 10.30 | 4.67 | 4.04 | 9.85 | 4.45 |
| Melhoramentos | Fofura | | 2 | 9.06 | 7.45 | 8.13 | 5.03 | 6.97 | 3.03 |
| Kimberly-Clark | Lys | | 2 | 11.41 | 8.75 | 6.63 | 5.08 | 8.93 | 4.60 |
| Kimberly-Clark | Cottenelle | Dilbert | 1 | 13.23 | 8.24 | 8.31 | 5.16 | 5.45 | 4.18 |
| Kimberly-Clark | Scottex | double roll | 2 | 14.29 | 11.92 | 10.25 | 5.21 | 16.34 | 8.28 |
| Kimberly-Clark | Kleenex | | 1 | 16.18 | 8.80 | 4.19 | 5.87 | 11.07 | 4.87 |
| Kimberly-Clark | Kerlisu | | 2 | 18.73 | 9.02 | 6.35 | 6.20 | 21.19 | 5.95 |
| Kimberly-Clark | Cottenelle | Ironman 1.2 | 1 | 13.20 | 7.19 | 5.38 | 6.39 | 8.32 | 3.88 |
| GP | Kirkland Signature | | 2 | 23.38 | 9.24 | 6.25 | 6.41 | 22.50 | 5.28 |
| P&G | Charmin | | 1 | 22.78 | 8.55 | 3.32 | 6.70 | 12.53 | 4.53 |
| Kimberly-Clark | Kleenex | Printed | 2 | 23.02 | 7.51 | 5.34 | 6.91 | 18.75 | 4.13 |
| Kimberly-Clark | Cottenelle | Linea Dorada | 2 | 17.30 | 10.14 | 7.53 | 6.94 | 17.55 | 9.35 |
| P&G | Charmin | Ultra | 2 | 17.91 | 9.69 | 5.49 | 7.35 | 12.27 | 6.05 |
| Kimberly-Clark | Popee | Plus | 2 | 20.82 | 9.27 | 6.76 | 7.52 | 23.86 | 5.88 |
| | Albert Heijn | mainline | 2 | 11.27 | 7.85 | 12.81 | 7.56 | 14.15 | 4.46 |
| P&G | Charmin | Plus | 1 | 23.85 | 8.71 | 3.09 | 7.75 | 14.14 | 5.45 |
| P&G | Codi | | 2 | 11.34 | 7.76 | 9.26 | 7.91 | 14.53 | 5.01 |
| Nibong Tebal | Royal Gold | | 3 | 30.01 | 8.88 | 9.23 | 7.94 | 57.19 | 7.40 |
| Kimberly-Clark | Cottenelle | Aloe & E | 1 | 13.43 | 7.42 | 6.44 | 7.94 | 9.52 | 4.72 |
| Kimberly-Clark | Page | mainline | 1 | 20.85 | 8.19 | 6.01 | 7.95 | 18.33 | 6.62 |
| Monalisa | Good Morning | | 2 | 22.00 | 8.37 | 7.88 | 8.01 | 25.77 | 5.52 |
| GP | Northern | | 2 | 17.65 | 6.85 | 6.74 | 8.07 | 15.11 | 3.98 |
| Papeles Nacionales | Joya | Economico | 2 | 6.58 | 6.79 | 24.93 | 8.13 | 9.51 | 4.14 |
| Kimberly-Clark | Cottenelle | Ultra | 2 | 10.66 | 8.40 | 10.36 | 8.14 | 10.94 | 6.15 |
| Kimberly-Clark | Scottex | mainline | 2 | 11.14 | 9.52 | 11.93 | 8.21 | 14.13 | 7.99 |
| Kimberly-Clark | Fiesta | — | 1 | 16.29 | 5.40 | 4.60 | 8.22 | 11.25 | 3.39 |
| Kimberly-Clark | Scottex | mainline | 2 | 13.03 | 6.83 | 8.71 | 8.26 | 16.22 | 4.56 |
| Kimberly-Clark | Kleenex | | 2 | 29.00 | 7.46 | 6.44 | 8.32 | 32.80 | 5.11 |
| Kimberly-Clark | Kirkland Signature | Evt #1 | 2 | 29.04 | 6.99 | 5.20 | 8.36 | 26.18 | 4.34 |
| Kimberly-Clark | Member's Mark | | 2 | 18.04 | 6.64 | 7.22 | 8.37 | 18.32 | 4.08 |
| Kimberly-Clark | Carlton | 1-Ply | 1 | 14.25 | 6.69 | 11.03 | 8.40 | 15.91 | 3.86 |
| Cimic | Hygienix | | 2 | 13.85 | 5.72 | 8.04 | 8.48 | 16.08 | 3.89 |
| Kimberly-Clark | Kirkland Signature | Evt #3 | 2 | 25.24 | 6.87 | 4.69 | 8.49 | 19.53 | 4.22 |
| Metsa/Soffass | Soft & Easy | | 2 | 14.11 | 8.67 | 10.34 | 8.51 | 24.26 | 6.59 |
| Kimberly-Clark | Tiss Soff | | 2 | 21.03 | 8.29 | 6.35 | 8.52 | 22.97 | 6.03 |
| GP | Angel Soft | | 2 | 16.14 | 7.39 | 11.44 | 8.61 | 22.70 | 4.89 |
| Nibong Tebal | Cutie | Soft | 2 | 27.54 | 8.59 | 5.29 | 8.73 | 48.26 | 6.79 |
| Berli Jucker Cellox | Cellox | | 2 | 16.67 | 6.63 | 7.02 | 8.85 | 18.33 | 4.84 |
| Kimberly-Clark | WalMart | Great Value | 2 | 12.98 | 8.03 | 8.94 | 8.94 | 15.19 | 5.98 |
| Nampak | Twinsaver | 1-Ply | 1 | 13.68 | 7.09 | 7.82 | 8.97 | 13.58 | 4.52 |
| Copamex | Regio | | 2 | 12.84 | 6.21 | 9.09 | 9.04 | 14.58 | 4.23 |
| Yung feng yu | Mayflower | | 2 | 13.49 | 6.69 | 13.20 | 9.13 | 26.39 | 4.89 |
| Tronchetti | Foxy | Super Soft | 2 | 15.36 | 7.91 | 8.15 | 9.31 | 18.70 | 6.60 |
| Kimberly-Clark | Andrex | | 2 | 19.54 | 6.76 | 6.29 | 9.57 | 19.00 | 5.20 |
| GP | Walgreen | 1000 | 1 | 11.94 | 5.36 | 10.35 | 9.67 | 10.94 | 3.41 |
| Kimberly-Clark | Velvet | | 2 | 21.72 | 9.34 | 9.58 | 9.72 | 56.84 | 10.39 |
| Kimberly-Clark | Scott | Deluxe | 2 | 13.33 | 5.99 | 6.36 | 9.72 | 11.10 | 3.64 |
| Delicarta | Aldi Solo | 3-ply | 3 | 12.19 | 6.85 | 12.72 | 9.96 | 21.31 | 5.72 |
| Nampak | Twinsoft | 2 Ply | 2 | 11.63 | 6.25 | 9.08 | 9.97 | 14.16 | 5.08 |
| Kimberly-Clark | Sujay | | 3 | 23.75 | 8.78 | 8.82 | 10.04 | 40.77 | 8.14 |
| Kimberly-Clark | Wondersoft | | 2 | 29.19 | 7.74 | 3.49 | 10.09 | 22.09 | 7.27 |
| Kimberly-Clark | Scott | Extra | 2 | 22.94 | 7.88 | 4.41 | 10.10 | 24.40 | 7.16 |
| SCA | Sorbent | Extra Thick | 3 | 17.32 | 7.87 | 8.54 | 10.11 | 26.03 | 6.12 |
| Kimberly-Clark | Scottenelle | | 2 | 7.10 | 6.40 | 11.62 | 10.30 | 8.51 | 5.35 |
| Kimberly-Clark | Scott | Gold | 2 | 14.20 | 4.99 | 7.96 | 10.31 | 12.99 | 3.04 |
| Delitissue | Regina | | 2 | 16.20 | 8.34 | 10.12 | 10.33 | 31.81 | 8.47 |
| P&G | Charmin | Basic | 1 | 25.48 | 5.78 | 11.29 | 10.36 | 18.47 | 3.95 |
| Nibong Tebal | Cutie | Compact | 2 | 20.67 | 7.40 | 11.01 | 10.40 | 36.25 | 5.69 |
| Tien Long Paper | Andante | | 2 | 18.32 | 6.48 | 5.85 | 10.65 | 19.97 | 5.40 |
| Papeles Nacionales | Suave | Premium Gold | 2 | 20.16 | 5.09 | 6.43 | 10.67 | 18.46 | 3.45 |
| Potlatch | Albertson's | | 1 | 17.19 | 6.00 | 9.76 | 10.81 | 17.78 | 4.57 |
| GP | Colhogar | mainline | 2 | 15.27 | 5.70 | 8.63 | 10.81 | 18.13 | 4.95 |
| Kimberly-Clark | Flamingo | | 2 | 12.48 | 6.82 | 12.29 | 10.95 | 19.21 | 5.01 |
| Kimberly-Clark | Scott | 1-ply | 1 | 17.56 | 5.76 | 7.30 | 10.98 | 15.38 | 3.66 |
| P&G | Charmin | Comfort | 2 | 20.49 | 8.85 | 9.05 | 11.16 | 27.39 | 9.45 |
| P&G | Charmin | Suave Aroma | 2 | 18.21 | 6.12 | 7.96 | 11.18 | 21.05 | 5.35 |
| Delitissue | Regina | | 3 | 15.50 | 9.03 | 12.25 | 11.37 | 32.18 | 10.21 |
| ICT | Foxy | Super Soft | 2 | 21.38 | 8.40 | 9.35 | 11.47 | 31.45 | 7.82 |

-continued

| Manufacturer | Brand | Sub-Brand | Plies (number) | MD-Dry Stretch (%) | CD-DRY Stretch (%) | MD-Dry Slope (kg) | CD-DRY Slope (kg) | MD-Dry TEA (gm-cm/cm2) | CD-DRY TEA (gm/cm/cm2) |
|---|---|---|---|---|---|---|---|---|---|
| CMPC | Elite | Diseno 2-ply | 2 | 9.99 | 4.47 | 11.71 | 11.47 | 10.49 | 3.52 |
| Kimberly-Clark | KleenexSujay | | 2 | 23.38 | 6.76 | 6.65 | 11.56 | 29.63 | 6.03 |
| PT Pindo Deli | Paseo | | 3 | 22.19 | 7.90 | 6.97 | 11.63 | 31.39 | 7.78 |
| Carrara | Migros Soft | 3-ply | 3 | 18.10 | 8.82 | 12.60 | 11.65 | 38.70 | 10.49 |
| Kimberly-Clark | Andrex | POAR | 2 | 15.00 | 6.86 | 7.46 | 11.82 | 21.79 | 6.35 |
| Eroski | Linder | mainline | 2 | 11.55 | 5.63 | 10.65 | 11.90 | 16.16 | 4.28 |
| Kimberly-Clark | Scott | Select | 2 | 20.81 | 7.21 | 7.39 | 11.96 | 29.35 | 6.44 |
| GP | Tenderly | DermaSoft | 2 | 16.90 | 5.38 | 8.14 | 12.07 | 19.39 | 4.80 |
| GP | Northern | Ultra | 2 | 20.18 | 4.88 | 6.98 | 12.07 | 19.23 | 3.49 |
| Copamex | Flen | | 2 | 13.86 | 6.91 | 12.16 | 12.13 | 26.85 | 6.58 |
| | Dollar General | | 2 | 14.79 | 6.98 | 11.26 | 12.27 | 21.36 | 7.25 |
| Kimberly-Clark | Kleenex | Care | 2 | 13.91 | 6.03 | 13.96 | 12.35 | 22.91 | 5.11 |
| Sano | SanoSoft | | 2 | 14.88 | 7.37 | 10.29 | 12.37 | 24.45 | 8.42 |
| | Clean & Soft | International | 3 | 22.69 | 7.31 | 9.41 | 12.50 | 47.12 | 8.81 |
| Kimberly-Clark | Andrex | mainline | 2 | 21.68 | 6.86 | 5.80 | 12.54 | 25.90 | 5.81 |
| Kimberly-Clark | Scott | Plus Mas Metros | 2 | 9.19 | 6.24 | 15.73 | 12.60 | 10.82 | 4.71 |
| Kimberly-Clark | Scott | Natural | 2 | 14.40 | 5.96 | 8.30 | 12.82 | 15.09 | 4.85 |
| Kimberly-Clark | Neve | Neutro | 2 | 20.28 | 7.52 | 8.80 | 12.83 | 28.06 | 6.06 |
| Kimberly-Clark | Sujay | | 2 | 15.22 | 5.88 | 5.68 | 12.93 | 13.73 | 4.60 |
| Kimberly-Clark | Scott | Extra | 2 | 19.70 | 7.19 | 7.41 | 13.02 | 26.79 | 7.12 |
| DaeHan Pulp | K-Nara | | 2 | 13.30 | 6.04 | 13.86 | 13.14 | 18.57 | 4.89 |
| Kimberly-Clark | Tiss | — | 2 | 16.37 | 5.52 | 7.25 | 13.39 | 20.03 | 5.30 |
| | Coop Italia | mainline | 2 | 12.58 | 5.22 | 11.29 | 13.54 | 21.36 | 4.76 |
| Kimberly-Clark | Kleenex | Care | 2 | 19.26 | 5.70 | 6.88 | 13.83 | 17.53 | 4.54 |
| Santher | Personal | 1-ply | 1 | 17.50 | 6.20 | 11.45 | 13.93 | 24.45 | 5.57 |
| Santher | Personal | Premium | 2 | 21.47 | 5.01 | 6.74 | 14.04 | 23.90 | 4.25 |
| P&G | Charmin | Comfort | 2 | 18.46 | 8.93 | 8.03 | 14.06 | 27.35 | 11.72 |
| Kimberly-Clark | Molett | | 2 | 16.98 | 6.49 | 9.38 | 14.25 | 25.22 | 6.11 |
| Kimberly-Clark | Kleenex | Baby Soft | 2 | 18.64 | 5.43 | 7.73 | 14.50 | 22.65 | 4.74 |
| P&G | Charmin | | 2 | 17.29 | 5.59 | 7.55 | 14.53 | 18.11 | 5.22 |
| Kimberly-Clark | Delsey | | 2 | 14.86 | 6.68 | 10.66 | 14.57 | 11.21 | 6.90 |
| Kimberly-Clark | Kleenex | Boutique | 2 | 15.30 | 4.68 | 7.07 | 14.57 | 14.27 | 3.62 |
| ABC Tissue Products | Quilton | | 3 | 16.89 | 6.89 | 10.77 | 14.67 | 27.95 | 7.25 |
| Kimberly-Clark | Neve | Elegance | 2 | 20.96 | 5.74 | 7.06 | 14.68 | 26.64 | 4.69 |
| Papeles Nacionales | Suave | | 2 | 23.15 | 4.91 | 6.63 | 14.68 | 23.42 | 3.97 |
| Irving | Soft Weve | | 1 | 16.69 | 4.56 | 11.70 | 14.73 | 16.87 | 3.18 |
| Kimberly-Clark | Andrex | Ultra (for HK) | 3 | 10.70 | 5.71 | 12.75 | 14.76 | 16.54 | 5.36 |
| Kimberly-Clark | Suavel | | 2 | 17.87 | 6.71 | 8.72 | 14.89 | 22.83 | 7.47 |
| SCA | ASDA Shades | | 2 | 11.29 | 6.63 | 12.69 | 14.93 | 19.52 | 8.77 |
| Familia Sancela | Familia | Ultra Suave | 2 | 14.65 | 4.28 | 8.06 | 15.16 | 14.76 | 3.48 |
| Familia Sancela | Familia | Economico | 2 | 15.73 | 5.11 | 11.60 | 15.18 | 21.75 | 4.49 |
| Kimberly-Clark | Kleenex | Ultra Care | 3 | 10.75 | 6.36 | 11.29 | 15.22 | 17.56 | 6.14 |
| CMPC | Elite | Extra | 2 | 12.99 | 6.99 | 11.92 | 15.38 | 20.46 | 8.32 |
| Kimberly-Clark | Nice | 1-ply | 1 | 17.95 | 3.65 | 7.08 | 15.39 | 17.74 | 2.13 |
| Kimberly-Clark | Scott | Deluxe | 3 | 12.77 | 5.84 | 9.27 | 15.60 | 19.28 | 6.30 |
| GP | Tesco | mainline | 2 | 33.37 | 7.21 | 5.37 | 15.69 | 40.55 | 7.53 |
| Melhoramentos | Sublime | | 1 | 11.67 | 3.47 | 6.08 | 15.69 | 6.91 | 1.95 |
| | Carrefour | Classic | 2 | 10.46 | 5.79 | 15.83 | 15.80 | 21.79 | 6.82 |
| SCA | Carrefour | mainline | 2 | 12.26 | 5.64 | 18.05 | 15.89 | 23.83 | 5.72 |
| Kimberly-Clark | Servus | 3-ply | 3 | 13.25 | 7.19 | 15.31 | 15.92 | 29.96 | 9.64 |
| Kimberly-Clark | Fancy | | 2 | 16.67 | 5.44 | 7.37 | 15.98 | 19.97 | 5.51 |
| Kimberly-Clark | Scott | 1000 | 1 | 18.50 | 5.15 | 9.00 | 16.01 | 18.68 | 4.32 |
| Copamex | Lady Regio | | 2 | 21.36 | 6.73 | 9.94 | 16.02 | 31.53 | 7.35 |
| P&G | Tender | | 2 | 14.64 | 4.27 | 7.79 | 16.06 | 18.58 | 4.14 |
| Kimberly-Clark | Hakle Kamille | 3-ply | 3 | 19.31 | 7.61 | 10.38 | 16.08 | 44.14 | 10.93 |
| | Coop Super Soft | | 4 | 13.80 | 7.07 | 16.27 | 16.13 | 37.32 | 11.54 |
| | Clean & Soft | C & S | 3 | 32.53 | 6.32 | 10.49 | 16.18 | 76.19 | 9.08 |
| Kimberly-Clark | Lily | | 2 | 25.06 | 5.82 | 5.29 | 16.20 | 26.40 | 5.52 |
| Delicarta | AS Schlecker | Premium | 4 | 12.45 | 7.68 | 13.46 | 16.34 | 21.85 | 10.50 |
| Kimberly-Clark | Petalo | Classico | 2 | 14.19 | 5.08 | 13.85 | 16.36 | 25.39 | 5.38 |
| Kimberly-Clark | Kleenex | (Bahrain tissue) | 2 | 31.08 | 6.55 | 6.77 | 16.52 | 33.50 | 5.88 |
| Familia Sancela | Familia | Cuidado | 2 | 17.04 | 3.84 | 7.42 | 16.63 | 15.62 | 3.01 |
| Kimberly-Clark | Scott | Gold | 2 | 19.26 | 4.47 | 5.93 | 16.77 | 15.86 | 4.11 |
| | Denner | | 4 | 10.08 | 7.57 | 19.79 | 17.40 | 26.26 | 12.53 |
| Marcal | Marcal | | 1 | 12.30 | 4.00 | 13.75 | 17.42 | 13.68 | 2.96 |
| Yuen Foong Yu | Mayflower | | 2 | 19.69 | 5.52 | 8.74 | 17.54 | 28.41 | 5.59 |
| Kimberly-Clark | Nice | Gold | 2 | 17.73 | 4.15 | 9.59 | 17.54 | 30.72 | 4.10 |
| APP group | Virjoy | 2-ply | 2 | 18.14 | 5.35 | 8.42 | 17.55 | 35.26 | 7.41 |
| APP group | Virjoy | Premium | 3 | 31.49 | 6.61 | 7.41 | 17.73 | 48.27 | 8.54 |

-continued

| Manufacturer | Brand | Sub-Brand | Plies (number) | MD-Dry Stretch (%) | CD-DRY Stretch (%) | MD-Dry Slope (kg) | CD-DRY Slope (kg) | MD-Dry TEA (gm-cm/cm2) | CD-DRY TEA (gm/cm/cm2) |
|---|---|---|---|---|---|---|---|---|---|
| Productos Tissue del Peru | Noble | 1-ply | 1 | 10.79 | 5.27 | 10.57 | 17.75 | 13.37 | 5.91 |
| Kimberly-Clark | Suave | Extra | 1 | 13.41 | 4.22 | 8.23 | 18.01 | 12.89 | 3.48 |
| Kimberly-Clark | Scott | Gold Ultra | 3 | 10.48 | 5.39 | 12.55 | 18.13 | 18.82 | 7.01 |
| CMPC | Elite | Doble Hoja | 2 | 14.84 | 5.74 | 10.34 | 18.44 | 22.08 | 6.05 |
| Kimberly-Clark | Hakle Kamille | 3-ply | 3 | 18.40 | 7.33 | 11.70 | 18.55 | 54.35 | 12.15 |
| GP | Zewa Lind | 3-ply | 3 | 14.77 | 7.19 | 16.72 | 18.72 | 34.75 | 11.52 |
| SCA | Edet | Friendly | 3 | 20.50 | 7.14 | 13.50 | 18.72 | 47.17 | 12.27 |
| Kimberly-Clark | Suave | Plus | 2 | 12.82 | 5.07 | 11.43 | 19.53 | 16.57 | 5.55 |
| Kimberly-Clark | Kleenex | 500 | 2 | 16.55 | 4.81 | 16.64 | 19.64 | 29.64 | 5.56 |
| Metsa | Lambi | | 3 | 21.24 | 6.51 | 13.43 | 19.95 | 44.07 | 10.46 |
| CMPC | Elite | 1-ply | 1 | 11.55 | 3.96 | 9.13 | 20.08 | 13.06 | 4.00 |
| Kimberly-Clark | Suave | Gold | 2 | 19.09 | 4.55 | 8.18 | 20.15 | 21.09 | 4.33 |
| GP | Lotus | Finesse | 2 | 21.14 | 5.84 | 9.18 | 20.41 | 34.26 | 7.02 |
| LIDL | Siempre | | 4 | 14.78 | 6.76 | 16.23 | 20.86 | 43.49 | 12.55 |
| CMPC | Elite | Premium | 3 | 18.49 | 5.57 | 10.37 | 21.04 | 35.01 | 7.05 |
| | Vinda | regular | 3 | 22.87 | 5.07 | 11.78 | 21.06 | 46.72 | 7.71 |
| | Migros Soft | Extra | 4 | 12.96 | 6.70 | 18.78 | 21.12 | 36.21 | 13.00 |
| Soffass | Regina | Rotolini | 2 | 14.42 | 4.96 | 16.69 | 21.67 | 26.76 | 6.97 |
| APP group | Virjoy | Extra Soft | 3 | 23.02 | 5.47 | 10.33 | 22.15 | 40.07 | 8.45 |
| | Favorita | Plus | 2 | 12.87 | 4.18 | 9.05 | 22.27 | 19.68 | 4.85 |
| SCA | Velvet | | 2 | 26.31 | 4.66 | 5.79 | 22.41 | 31.74 | 5.69 |
| Soffass | Regina | Cartacomomilla | 4 | 11.61 | 5.75 | 22.30 | 23.01 | 33.22 | 9.89 |
| CMPC | Elite | con Oso | 2 | 19.84 | 5.20 | 9.95 | 23.50 | 30.67 | 6.24 |
| | Vinda | premium | 3 | 21.63 | 5.80 | 14.92 | 23.55 | 48.54 | 8.19 |
| Vinda | Vinda blue | | 3 | 19.57 | 4.64 | 16.04 | 24.65 | 45.74 | 7.74 |
| | Aldi Kokett | | 4 | 17.35 | 6.72 | 21.09 | 26.03 | 48.02 | 11.60 |
| Kimberly-Clark | Vogue | | 2 | 11.11 | 4.25 | 30.50 | 27.18 | 23.95 | 5.31 |
| Familia Sancela | Familia | Cuidado | 2 | 14.37 | 2.97 | 7.55 | 28.82 | 13.66 | 3.29 |
| San Francisco | Hortensia | | 2 | 16.96 | 3.90 | 14.02 | 48.80 | 33.76 | 8.02 |

| Manufacturer | Brand | Sub-Brand | Plies (number) | CDT/CD Stretch | CDT/CD TEA | CDTEA/CDS |
|---|---|---|---|---|---|---|
| | Sample 1 | Code 220 | 1 | 20.8 | 85.0 | 0.245 |
| | Sample 2 | Code 4 | 1 | 30.9 | 91.3 | 0.338 |
| | Sample 3 | Code 6 | 1 | 34.7 | 90.8 | 0.382 |
| | Sample 4 | Code 219 | 1 | 24.6 | 91.0 | 0.270 |
| | Sample 5 | Code 218 | 1 | 27.7 | 95.9 | 0.289 |
| | Sample 6 | Code 64 | 1 | 35.9 | 100.4 | 0.357 |
| | Sample 7 | Code 65 | 1 | 35.1 | 99.4 | 0.353 |
| | Sample 8 | Code 5 | 1 | 33.3 | 95.8 | 0.348 |
| | Sample 9 | Code 66 | 1 | 43.9 | 102.4 | 0.429 |
| | Sample 10 | Code 67 | 1 | 44.5 | 100.6 | 0.442 |
| | Sample 11 | Code 217 | 1 | 32.5 | 103.2 | 0.315 |
| Kimberly-Clark | Classic | | 2 | 30.4 | 59.1 | 0.514 |
| SCA | Sorbent | Orginal | 2 | 31.6 | 49.9 | 0.633 |
| Kimberly-Clark | Petalo | Sensations | 1 | 58.7 | 136.0 | 0.432 |
| Melhoramentos | Fofura | | 2 | 41.7 | 102.6 | 0.407 |
| Kimberly-Clark | Lys | | 2 | 43.5 | 82.8 | 0.526 |
| Kimberly-Clark | Cottenelle | Dilbert | 1 | 60.8 | 119.9 | 0.507 |
| Kimberly-Clark | Scottex | double roll | 2 | 60.7 | 87.4 | 0.695 |
| Kimberly-Clark | Kleenex | | 1 | 75.9 | 137.2 | 0.553 |
| Kimberly-Clark | Kerlisu | | 2 | 62.9 | 95.3 | 0.660 |
| Kimberly-Clark | Cottenelle | Ironman 1.2 | 1 | 68.0 | 126.0 | 0.540 |
| GP | Kirkland Signature | | 2 | 46.2 | 80.9 | 0.571 |
| P&G | Charmin | | 1 | 53.9 | 101.8 | 0.530 |
| Kimberly-Clark | Kleenex | Printed | 2 | 66.0 | 120.1 | 0.550 |
| Kimberly-Clark | Cottenelle | Linea Dorada | 2 | 91.8 | 99.6 | 0.922 |
| P&G | Charmin | Ultra | 2 | 52.9 | 84.8 | 0.624 |
| Kimberly-Clark | Popee | Plus | 2 | 62.9 | 99.1 | 0.634 |
| | Albert Heijn | mainline | 2 | 60.6 | 106.7 | 0.568 |
| P&G | Charmin | Plus | 1 | 59.1 | 94.5 | 0.626 |
| P&G | Codi | | 2 | 67.1 | 104.0 | 0.646 |
| Nibong Tebal | Royal Gold | | 3 | 64.1 | 76.9 | 0.833 |
| Kimberly-Clark | Cottenelle | Aloe & E | 1 | 85.2 | 133.9 | 0.636 |
| Kimberly-Clark | Page | mainline | 1 | 116.7 | 144.4 | 0.808 |
| Monalisa | Good Morning | | 2 | 56.2 | 85.1 | 0.659 |

-continued

| Manufacturer | Brand | Sub-Brand | Plies (number) | CDT/CD Stretch | CDT/CD TEA | CDTEA/CDS |
|---|---|---|---|---|---|---|
| GP | Northern | | 2 | 58.1 | 100.0 | 0.581 |
| Papeles Nacionales | Joya | Economico | 2 | 60.5 | 99.3 | 0.610 |
| Kimberly-Clark | Cottenelle | Ultra | 2 | 83.3 | 113.8 | 0.732 |
| Kimberly-Clark | Scottex | mainline | 2 | 74.4 | 88.6 | 0.839 |
| Kimberly-Clark | Fiesta | — | 1 | 81.1 | 129.2 | 0.628 |
| Kimberly-Clark | Scottex | mainline | 2 | 71.2 | 106.6 | 0.668 |
| Kimberly-Clark | Kleenex | | 2 | 63.7 | 93.0 | 0.685 |
| Kimberly-Clark | Kirkland Signature | Evt #1 | 2 | 64.1 | 103.2 | 0.621 |
| Kimberly-Clark | Member's Mark | | 2 | 77.3 | 125.7 | 0.614 |
| Kimberly-Clark | Carlton | 1-Ply | 1 | 65.8 | 114.0 | 0.577 |
| Cimic | Hygienix | | 2 | 93.4 | 137.3 | 0.680 |
| Kimberly-Clark | Kirkland Signature | Evt #3 | 2 | 68.6 | 111.6 | 0.614 |
| Metsa/Soffass | Soft & Easy | | 2 | 70.6 | 92.9 | 0.760 |
| Kimberly-Clark | Tiss Soff | | 2 | 86.5 | 118.9 | 0.727 |
| GP | Angel Soft | | 2 | 61.4 | 92.8 | 0.662 |
| Nibong Tebal | Cutie | Soft | 2 | 83.1 | 105.2 | 0.790 |
| Berli Jucker Cellox | Cellox | | 2 | 87.3 | 119.6 | 0.730 |
| Kimberly-Clark | WalMart | Great Value | 2 | 68.2 | 91.6 | 0.745 |
| Nampak | Twinsaver | 1-Ply | 1 | 78.7 | 123.5 | 0.638 |
| Copamex | Regio | | 2 | 72.3 | 106.1 | 0.681 |
| Yung feng yu | Mayflower | | 2 | 80.6 | 110.2 | 0.731 |
| Tronchetti | Foxy | Super Soft | 2 | 82.2 | 98.5 | 0.834 |
| Kimberly-Clark | Andrex | | 2 | 92.0 | 119.6 | 0.769 |
| GP | Walgreen | 1000 | 1 | 81.2 | 127.6 | 0.636 |
| Kimberly-Clark | Velvet | | 2 | 100.0 | 89.9 | 1.112 |
| Kimberly-Clark | Scott | Deluxe | 2 | 87.5 | 144.0 | 0.608 |
| Delicarta | Aldi Solo | 3-ply | 3 | 87.3 | 104.5 | 0.835 |
| Nampak | Twinsoft | 2 Ply | 2 | 102.2 | 125.8 | 0.813 |
| Kimberly-Clark | Sujay | | 3 | 96.5 | 104.1 | 0.927 |
| Kimberly-Clark | Wondersoft | | 2 | 95.1 | 101.2 | 0.939 |
| Kimberly-Clark | Scott | Extra | 2 | 87.3 | 96.1 | 0.909 |
| SCA | Sorbent | Extra Thick | 3 | 91.5 | 117.6 | 0.778 |
| Kimberly-Clark | Scottenelle | | 2 | 104.4 | 124.9 | 0.836 |
| Kimberly-Clark | Scott | Gold | 2 | 98.8 | 162.2 | 0.609 |
| Delitissue | Regina | | 2 | 105.3 | 103.7 | 1.016 |
| P&G | Charmin | Basic | 1 | 100.3 | 146.8 | 0.683 |
| Nibong Tebal | Cutie | Compact | 2 | 83.8 | 109.0 | 0.769 |
| Tien Long Paper | Andante | | 2 | 104.2 | 125.0 | 0.833 |
| Papeles Nacionales | Suave | Premium Gold | 2 | 88.6 | 130.7 | 0.678 |
| Potlatch | Albertson's | | 1 | 87.8 | 115.3 | 0.762 |
| GP | Colhogar | mainline | 2 | 90.4 | 104.0 | 0.868 |
| Kimberly-Clark | Flamingo | | 2 | 78.4 | 106.8 | 0.735 |
| Kimberly-Clark | Scott | 1-ply | 1 | 91.8 | 144.5 | 0.635 |
| P&G | Charmin | Comfort | 2 | 109.7 | 102.8 | 1.068 |
| P&G | Charmin | Suave Aroma | 2 | 103.3 | 118.1 | 0.874 |
| Delitissue | Regina | | 3 | 96.1 | 85.0 | 1.131 |
| ICT | Foxy | Super Soft | 2 | 98.8 | 106.1 | 0.931 |
| CMPC | Elite | Diseno 2-ply | 2 | 108.7 | 138.1 | 0.787 |
| Kimberly-Clark | KleenexSujay | | 2 | 132.8 | 148.9 | 0.892 |
| PT Pindo Deli | Paseo | | 3 | 103.2 | 104.8 | 0.985 |
| Carrara | Migros Soft | 3-ply | 3 | 107.5 | 90.4 | 1.189 |
| Kimberly-Clark | Andrex | POAR | 2 | 106.9 | 115.4 | 0.926 |
| Eroski | Linder | mainline | 2 | 123.3 | 162.1 | 0.760 |
| Kimberly-Clark | Scott | Select | 2 | 118.3 | 132.5 | 0.893 |
| GP | Tenderly | DermaSoft | 2 | 92.8 | 104.0 | 0.892 |
| GP | Northern | Ultra | 2 | 87.9 | 122.9 | 0.715 |
| Copamex | Flen | | 2 | 118.8 | 124.8 | 0.952 |
| | Dollar General | | 2 | 98.6 | 94.9 | 1.039 |
| Kimberly-Clark | Kleenex | Care | 2 | 113.3 | 133.7 | 0.847 |
| Sano | SanoSoft | | 2 | 121.2 | 106.1 | 1.142 |
| | Clean & Soft | International | 3 | 117.8 | 97.7 | 1.205 |
| Kimberly-Clark | Andrex | mainline | 2 | 94.9 | 112.0 | 0.847 |
| Kimberly-Clark | Scott | Plus Mas Metros | 2 | 106.9 | 141.6 | 0.755 |
| Kimberly-Clark | Scott | Natural | 2 | 112.2 | 137.9 | 0.814 |
| Kimberly-Clark | Neve | Neutro | 2 | 97.2 | 120.6 | 0.806 |
| Kimberly-Clark | Sujay | | 2 | 122.6 | 156.7 | 0.782 |
| Kimberly-Clark | Scott | Extra | 2 | 115.7 | 116.9 | 0.990 |
| DaeHan Pulp | K-Nara | | 2 | 121.9 | 150.5 | 0.810 |
| Kimberly-Clark | Tiss | — | 2 | 154.0 | 160.4 | 0.960 |
| | Coop Italia | mainline | 2 | 143.3 | 157.1 | 0.912 |
| Kimberly-Clark | Kleenex | Care | 2 | 134.4 | 168.7 | 0.796 |
| Santher | Personal | 1-ply | 1 | 147.3 | 163.9 | 0.898 |

-continued

| Manufacturer | Brand | Sub-Brand | Plies (number) | CDT/CD Stretch | CDT/CD TEA | CDTEA/CDS |
|---|---|---|---|---|---|---|
| Santher | Personal | Premium | 2 | 133.7 | 157.6 | 0.848 |
| P&G | Charmin | Comfort | 2 | 136.3 | 103.8 | 1.312 |
| Kimberly-Clark | Molett | | 2 | 128.2 | 136.2 | 0.941 |
| Kimberly-Clark | Kleenex | Baby Soft | 2 | 133.5 | 153.0 | 0.873 |
| P&G | Charmin | | 2 | 122.4 | 131.0 | 0.934 |
| Kimberly-Clark | Delsey | | 2 | 116.2 | 112.5 | 1.033 |
| Kimberly-Clark | Kleenex | Boutique | 2 | 127.8 | 165.2 | 0.774 |
| ABC Tissue Products | Quilton | | 3 | 113.4 | 107.7 | 1.052 |
| Kimberly-Clark | Neve | Elegance | 2 | 133.3 | 163.1 | 0.817 |
| Papeles Nacionales | Suave | | 2 | 120.6 | 149.1 | 0.809 |
| Irving | Soft Weve | | 1 | 109.2 | 156.6 | 0.697 |
| Kimberly-Clark | Andrex | Ultra (for HK) | 3 | 147.3 | 156.9 | 0.939 |
| Kimberly-Clark | Suavel | | 2 | 124.3 | 111.6 | 1.113 |
| | ASDA | | | | | |
| SCA | Shades | | 2 | 164.3 | 124.2 | 1.323 |
| Familia Sancela | Familia | Ultra Suave | 2 | 138.6 | 170.4 | 0.813 |
| Familia Sancela | Familia | Economico | 2 | 149.9 | 170.6 | 0.879 |
| Kimberly-Clark | Kleenex | Ultra Care | 3 | 141.0 | 146.1 | 0.965 |
| CMPC | Elite | Extra | 2 | 173.2 | 145.6 | 1.190 |
| Kimberly-Clark | Nice | 1-ply | 1 | 148.5 | 254.5 | 0.584 |
| Kimberly-Clark | Scott | Deluxe | 3 | 156.3 | 144.9 | 1.079 |
| GP | Tesco | mainline | 2 | 103.1 | 98.7 | 1.044 |
| Melhoramentos | Sublime | | 1 | 138.3 | 246.2 | 0.562 |
| | Carrefour | Classic | 2 | 162.3 | 137.8 | 1.178 |
| SCA | Carrefour | mainline | 2 | 155.3 | 153.1 | 1.014 |
| Kimberly-Clark | Servus | 3-ply | 3 | 164.0 | 122.3 | 1.341 |
| Kimberly-Clark | Fancy | | 2 | 136.6 | 134.8 | 1.013 |
| Kimberly-Clark | Scott | 1000 | 1 | 112.8 | 134.5 | 0.839 |
| Copamex | Lady Regio | | 2 | 143.1 | 131.0 | 1.092 |
| P&G | Tender | | 2 | 166.3 | 171.5 | 0.970 |
| Kimberly-Clark | Hakle Kamille | 3-ply | 3 | 166.1 | 115.6 | 1.436 |
| | Coop Super Soft | | 4 | 179.5 | 110.0 | 1.632 |
| | Clean & Soft | C & S | 3 | 149.8 | 104.3 | 1.437 |
| Kimberly-Clark | Lily | | 2 | 154.8 | 163.2 | 0.948 |
| Delicarta | AS Schlecker | Premium | 4 | 148.7 | 108.8 | 1.367 |
| Kimberly-Clark | Petalo | Classico (Bahrain tissue) | 2 | 185.0 | 174.7 | 1.059 |
| Kimberly-Clark | Kleenex | | 2 | 102.9 | 114.6 | 0.898 |
| Familia Sancela | Familia | Cuidado | 2 | 177.3 | 226.2 | 0.784 |
| Kimberly-Clark | Scott | Gold | 2 | 172.3 | 187.3 | 0.919 |
| | Denner | | 4 | 164.9 | 99.6 | 1.655 |
| Marcal | Marcal | | 1 | 141.8 | 191.6 | 0.740 |
| Yuen Foong Yu | Mayflower | | 2 | 144.2 | 142.4 | 1.013 |
| Kimberly-Clark | Nice | Gold | 2 | 186.5 | 188.8 | 0.988 |
| APP group | Virjoy | 2-ply | 2 | 188.6 | 136.2 | 1.385 |
| APP group | Virjoy | Premium | 3 | 138.1 | 106.9 | 1.292 |
| Productos Tissue del Peru | Noble | 1-ply | 1 | 247.4 | 220.6 | 1.121 |
| Kimberly-Clark | Suave | Extra | 1 | 195.5 | 237.1 | 0.825 |
| Kimberly-Clark | Scott | Gold Ultra | 3 | 210.9 | 162.2 | 1.301 |
| CMPC | Elite | Doble Hoja | 2 | 170.2 | 161.5 | 1.054 |
| Kimberly-Clark | Hakle Kamille | 3-ply | 3 | 212.8 | 128.4 | 1.658 |
| GP | Zewa Lind | 3-ply | 3 | 140.2 | 87.5 | 1.602 |
| SCA | Edet | Friendly | 3 | 160.5 | 93.4 | 1.718 |
| Kimberly-Clark | Suave | Plus | 2 | 198.0 | 180.9 | 1.095 |
| Kimberly-Clark | Kleenex | 500 | 2 | 145.7 | 126.1 | 1.156 |
| Metsa | Lambi | | 3 | 216.1 | 134.5 | 1.607 |
| CMPC | Elite | 1-ply | 1 | 218.9 | 216.8 | 1.010 |
| Kimberly-Clark | Suave | Gold | 2 | 201.5 | 211.8 | 0.952 |
| GP | Lotus | Finesse | 2 | 149.0 | 123.9 | 1.202 |
| LIDL | Siempre | | 4 | 219.1 | 118.0 | 1.857 |
| CMPC | Elite | Premium | 3 | 189.2 | 149.5 | 1.266 |
| | Vinda | regular | 3 | 187.0 | 123.0 | 1.521 |
| | Migros Soft | Extra | 4 | 213.6 | 110.1 | 1.940 |
| Soffass | Regina | Rotolini | 2 | 198.8 | 141.5 | 1.405 |
| APP group | Virjoy | Extra Soft | 3 | 193.2 | 125.1 | 1.545 |
| | Favorita | Plus | 2 | 207.7 | 179.0 | 1.160 |
| SCA | Velvet | | 2 | 192.7 | 157.8 | 1.221 |
| Soffass | Regina | Cartacomomilla | 4 | 237.6 | 138.1 | 1.720 |
| CMPC | Elite | con Oso | 2 | 190.8 | 159.0 | 1.200 |
| | Vinda | premium | 3 | 166.2 | 117.7 | 1.412 |
| Vinda | Vinda blue | | 3 | 224.6 | 134.6 | 1.668 |
| | Aldi Kokett | | 4 | 194.3 | 112.6 | 1.726 |
| Kimberly-Clark | Vogue | | 2 | 217.2 | 173.8 | 1.249 |

-continued

| Manufacturer | Brand | Sub-Brand | Plies (number) | CDT/CD Stretch | CDT/CD TEA | CDTEA/CDS |
|---|---|---|---|---|---|---|
| Familia Sancela | Familia | Cuidado | 2 | 344.4 | 310.9 | 1.108 |
| San Francisco | Hortensia | | 2 | 403.3 | 196.1 | 2.056 |

As shown above, the samples made according to the present disclosure exhibited improved properties especially in the cross-machine direction in comparison to the commercially available samples. The samples made according to the present disclosure had the highest cross-machine directional stretch and the lowest amount of cross directional tensile needed to create 1% of stretch. The samples made according to the present disclosure also exhibited the lowest amount of cross directional tensile energy absorbed to create 1% of stretch. Further, the samples made according to the present disclosure exhibited the lowest cross-machine directional slope compared to the commercial products.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A single ply tissue product comprising:

a single ply tissue web comprising pulp fibers, the tissue web having a dry bulk of at least 3 cc/g, the tissue web having a geometric mean tensile strength of between about 500 g/3 in and about 1,000 g/3 in, a cross-machine direction stretch of at least 15%, a cross-machine direction tensile strength/cross-machine direction stretch of less than about 50 and a cross-machine direction slope of less than about 3 kg; and the tissue web comprises a layered structure with at least one inner layer and two outer layers wherein an inner layer has a tensile strength equal to or greater than the tensile strength of at least one of the outer layers.

2. A single ply tissue product as defined in claim 1, wherein the tissue web also has a cross-machine direction tensile energy absorbed/cross-machine direction stretch of less than about 0.4.

3. A single ply tissue product as defined in claim 1, wherein the tissue web has a cross-machine direction stretch of at least 15% and a cross-machine direction tensile strength/cross-machine direction stretch of less than about 30.

4. A single ply tissue product as defined in claim 1, wherein the tissue web has a geometric mean tensile strength of between about 500 g/3 in and than about 900 g/3 in.

5. A single ply tissue product as defined in claim 1, wherein the tissue web has a geometric mean tensile strength of between about 500 g/3 in and than about 700 g/3 in.

6. A single ply tissue product as defined in claim 1, wherein the tissue web comprises an uncreped through-air dried web.

7. A single ply tissue product as defined in claim 6, wherein the tissue web has been formed in a wetlaid through-air dried process by being conveyed on a transfer fabric positioned immediately upstream of a through-air dryer fabric that is configured to convey the web through a through-air dryer, both the transfer fabric and the through-air dryer fabric comprising textured fabrics having a machine direction dominate design comprising from about 5 to about 15 raised elements per centimeter in the machine direction, the raised elements having a height of from about 0.3 mm to about 5 mm.

8. A single ply tissue product as defined in claim 7, wherein the raised elements have a height of from about 0.3 mm to about 1 mm.

9. A single ply tissue product as defined in claim 7, wherein the transfer fabric and the through-air dryer fabric have a machine direction dominate design that comprises from about 9 to about 11 raised elements per centimeter in the machine direction, the raised elements having a height of from about 0.3 mm to about 0.5 mm.

10. A single ply tissue product as defined in claim 7, wherein the raised elements on the transfer fabric and on the through-air dryer fabric comprise ridges, the ridges having a width of from about 0.3 mm to about 1 mm, the ridges, when viewed from the cross-machine direction, having a ridge frequency of from about 0.5 mm to about 2 mm.

11. A single ply tissue product as defined in claim 10, wherein the transfer fabric and the through-air dryer fabric comprise multi-layered fabrics.

12. A single ply tissue product as defined in claim 7, wherein the tissue web has been molded against at least one of the transfer fabric and the through-air dryer fabric during formation.

13. A single ply tissue product as defined in claim 1, wherein the tissue web has a basis weight of from about 15 gsm to about 45 gsm.

14. A single ply tissue product as defined in claim 1, wherein the tissue web has a Pinhole Coverage Index of about 0.25 or less.

15. A single ply tissue product as defined in claim 1, wherein the tissue web has a Pinhole Count Index of about 65 or less.

16. A single ply tissue product as defined in claim 1, wherein the tissue web has a Pinhole Size Index of about 600 or less.

17. A single ply tissue product as defined in claim 1, wherein the tissue web has a moisture content of less than about 8%.

18. A tissue product comprising:

at least one tissue web comprising pulp fibers, the tissue web having a dry bulk of at least 3 cc/g, the tissue web having a geometric mean tensile strength of between about 500 g/3 in and less about 1,000 g/3 in, a cross-machine direction stretch of at least 15%, a cross-machine direction tensile strength/cross-machine direction stretch of less than about 30 and a cross-machine direction slope of less than about 3 kg; and the tissue web comprises a layered structure with at least one inner layer and two outer layers wherein an inner layer has a tensile strength equal to or greater than the tensile strength of at least one of the outer layers.

19. A tissue product as defined in claim 18, wherein the tissue product contains only a single ply, the single ply comprising the tissue web.

20. A tissue product as defined in claim 18, wherein the tissue web also has a cross-machine direction tensile energy absorbed/cross-machine direction stretch of less than about 0.4.

21. A tissue product as defined in claim 18, wherein the tissue web has a geometric mean tensile strength of between about 500 g/3 in and than about 900 g/3 in.

22. A tissue product as defined in claim 18, wherein the tissue web has a geometric mean tensile strength of between about 500 g/3 in and than about 700 g/3 in.

23. A tissue product as defined in claim 18, wherein the tissue web comprises an uncreped through-air dried web.

24. A tissue product as defined in claim 23, wherein the tissue web has been formed in a wetlaid through-air dried process by being conveyed on a transfer fabric positioned immediately upstream of a through-air dryer fabric that is configured to convey the web through a through-air dryer, both the transfer fabric and the through-air dryer fabric comprising textured fabrics having a machine direction dominate design comprising from about 5 to about 15 raised elements per centimeter in the machine direction, the raised elements having a height of from about 0.3 mm to about 5 mm.

25. A tissue product as defined in claim 24, wherein the transfer fabric and the through-air dryer fabric have a machine direction dominate design that comprises from about 9 to about 11 raised elements per centimeter in the machine direction, the raised elements having a height of from about 0.3 mm to about 1 mm.

26. A tissue product as defined in claim 24, wherein the raised elements on the transfer fabric and on the through-air dryer fabric comprise ridges, the ridges having a width of from about 0.3 mm to about 1 mm, the ridges, when viewed from the cross-machine direction, having a ridge frequency of from about 0.5 mm to about 2 mm.

27. A tissue product as defined in claim 24, wherein the tissue web has been molded against at least one of the transfer fabric and the through-air dryer fabric during formation.

28. A tissue product as defined in claim 18, wherein the tissue web has a wherein the tissue web has a Pinhole Coverage Index of about 0.25 or less.

29. A single ply tissue product as defined in claim 18, wherein the tissue web has a Pinhole Count Index of about 65 or less.

30. A single ply tissue product as defined in claim 18, wherein the tissue web has a Pinhole Size Index of about 600 or less.

* * * * *

UNITED STATES PATENT AND TRADEMARK OFFICE

CERTIFICATE OF CORRECTION

PATENT NO. : 7,972,474 B2
APPLICATION NO. : 11/301632
DATED : July 5, 2011
INVENTOR(S) : Richard Underhill et al.

It is certified that error appears in the above-identified patent and that said Letters Patent is hereby corrected as shown below:

Col. 27, Claim 4, line 56 "...about 500 g/3 in and than about 900 g/3 in." should read --...about 500 g/3 in and about 900 g/3 in.--

Col. 27, Claim 5, line 59 "...about 500 g/3 in and than about 700 g/3 in." should read --...about 500 g/3 in and about 700 g/3 in.--

Col. 28, Claim 18, line 56 "...about 500 g/3 in and less about 1,000 g/3 in." should read --...about 500 g/3 in and about 1,000 g/3 in.--

Col. 29, Claim 21, line 7 "...about 500 g/3 in and than about 900 g/3 in." should read --...about 500 g/3 in and about 900 g/3 in.--

Signed and Sealed this
Thirtieth Day of August, 2011

David J. Kappos

David J. Kappos
*Director of the United States Patent and Trademark Office*